US009447611B2

(12) United States Patent
Conti et al.

(10) Patent No.: US 9,447,611 B2
(45) **Date of Patent: *Sep. 20, 2016**

(54) CABLE WRAP SECURITY DEVICE

(75) Inventors: Brian V. Conti, Matthews, NC (US); Christopher J. Fawcett, Charlotte, NC (US); David P. Christianson, Charlotte, NC (US); Mitchell S. Goldstein, Rock Hill, SC (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 1089 days.

This patent is subject to a terminal disclaimer.

(21) Appl. No.: 12/983,564

(22) Filed: Jan. 3, 2011

(65) Prior Publication Data

US 2011/0094274 A1 Apr. 28, 2011

Related U.S. Application Data

(63) Continuation of application No. 12/634,875, filed on Dec. 10, 2009, now Pat. No. 8,599,022, which is a continuation of application No. 12/027,296, filed on Feb. 7, 2008, now Pat. No. 8,122,744.

(60) Provisional application No. 60/920,546, filed on Mar. 28, 2007.

(51) Int. Cl.
*E05B 65/00* (2006.01)
*G08B 13/14* (2006.01)
(Continued)

(52) U.S. Cl.
CPC ..... *E05B 73/0017* (2013.01); *E05B 45/005* (2013.01); *E05B 73/0029* (2013.01);
(Continued)

(58) Field of Classification Search
CPC ..... E05B 73/0017; E05B 45/005; E05B 73/0052; E05B 73/0029; G08B 13/2434; G08B 13/1463; Y10T 70/483; Y10T 70/7904; Y10T 70/5009; Y10T 70/402; Y10T 70/50; Y10T 70/5031; Y10T 70/409; Y10T 70/5004; Y10T 70/7057
USPC ..... 70/57.1, 63, 276, 413, DIG. 49, 14, 18, 70/30, 49, 58, 233; 340/542, 568.2, 652, 340/571, 572.9, 568.4; 242/382, 385, 242/384.7, 385.4, 378, 378.1, 385.1, 385.2, 242/385.3
See application file for complete search history.

(56) References Cited

U.S. PATENT DOCUMENTS 343,849 A 6/1886 Pond
639,196 A 12/1899 Fehling
(Continued)

FOREIGN PATENT DOCUMENTS

DE 2725580 12/1977
EP 0620381 10/1994
(Continued)

*Primary Examiner* — Lloyd Gall
(74) *Attorney, Agent, or Firm* — Nelson Mullins Riley & Scarborough, LLP

(57) ABSTRACT

A security device includes a locking member, a ratchet mechanism, and a plurality of cables. The cables are wrapped around an object. An attachment clip is releasably snap-fitted into the body of the security device. The ratchet mechanism includes a spool and a locking pawl or lever. A key is used to unlock the clip from the housing. An alarm system is contained in the housing and actuates an audible alarm upon certain unauthorized actions occurring. Insertion of the clip into the housing automatically actuates the ratchet mechanism preventing movement of the cable in the unwind direction and activates the alarm system.

11 Claims, 24 Drawing Sheets

(51) Int. Cl.
*E05B 73/00* (2006.01)
*E05B 45/00* (2006.01)
*G08B 13/24* (2006.01)

(52) U.S. Cl.
CPC ..... *E05B73/0052* (2013.01); *G08B 13/1463* (2013.01); *G08B 13/2434* (2013.01); *Y10T 70/402* (2015.04); *Y10T 70/409* (2015.04); *Y10T 70/483* (2015.04); *Y10T 70/50* (2015.04); *Y10T 70/5004* (2015.04); *Y10T 70/5009* (2015.04); *Y10T 70/5031* (2015.04); *Y10T 70/7057* (2015.04); *Y10T 70/7904* (2015.04)

(56) References Cited

U.S. PATENT DOCUMENTS 1,124,130 A 1/1915 Grant
1,141,245 A 6/1915 Gillespie
3,395,555 A * 8/1968 Hickman ..... 70/39
3,397,849 A 8/1968 Hansen
3,611,760 A 10/1971 Muther
3,741,528 A 6/1973 Profet
3,906,758 A 9/1975 Hurwitt
3,929,300 A 12/1975 Lindqvist
4,086,795 A 5/1978 Foster et al.
4,418,551 A 12/1983 Kochackis
4,543,806 A 10/1985 Papandrea et al.
4,686,513 A 8/1987 Farrar et al.
4,756,171 A 7/1988 Homar
4,851,815 A 7/1989 Enkelmann
4,896,517 A 1/1990 Ling
4,930,324 A 6/1990 Meier
5,156,028 A 10/1992 Jiang
5,598,727 A * 2/1997 White ..... 70/233
5,656,998 A 8/1997 Fujiuchi et al.
5,722,266 A 3/1998 Yeager et al.
5,722,270 A * 3/1998 Yu ..... 70/209
5,764,147 A 6/1998 Sasagawa et al.
5,767,773 A 6/1998 Fujiuchi et al.
5,768,920 A * 6/1998 DeBevoise ..... 70/18
5,786,759 A * 7/1998 Ling ..... 340/542
5,794,464 A 8/1998 Yeager et al.
5,836,002 A 11/1998 Morstein et al.
5,960,652 A 10/1999 Marmstad
6,092,401 A 7/2000 Sankey et al.
6,755,055 B2 6/2004 Sedon et al.
7,002,467 B2 2/2006 Deconinck et al.
7,162,899 B2 1/2007 Fawcett et al.
7,168,275 B2 1/2007 Fawcett et al.
7,497,100 B2 3/2009 Fawcett et al.
7,685,850 B2 * 3/2010 Nilsson ..... 70/18
7,992,259 B2 8/2011 Goldstein et al.
8,122,744 B2 * 2/2012 Conti et al. ..... 70/57.1
8,281,626 B2 * 10/2012 Conti et al. ..... 70/57.1
8,528,372 B2 * 9/2013 Nilsson ..... 70/57.1
8,599,022 B2 * 12/2013 Conti et al. ..... 340/571
8,890,689 B2 * 11/2014 Ezzo et al. ..... 340/568.1
2003/0182763 A1 10/2003 Jeffries
2005/0223756 A1 10/2005 Ling et al.
2005/0231365 A1 10/2005 Tester et al.
2005/0242962 A1 11/2005 Lind et al.
2006/0170550 A1 8/2006 Marsilio
2007/0120669 A1 5/2007 Belden, Jr.
2007/0131005 A1 6/2007 Clare
2007/0146134 A1 6/2007 Belden et al.
2007/0194918 A1 8/2007 Rabinowitz et al.
2010/0101283 A1 * 4/2010 Xiaobin ..... 70/14
2011/0102179 A1 5/2011 Ezzo et al.
2012/0055209 A1 3/2012 Conti et al.

FOREIGN PATENT DOCUMENTS

JP 8279082 10/1996
SE 123470 11/1948
WO 2006/040693 4/2006

* cited by examiner

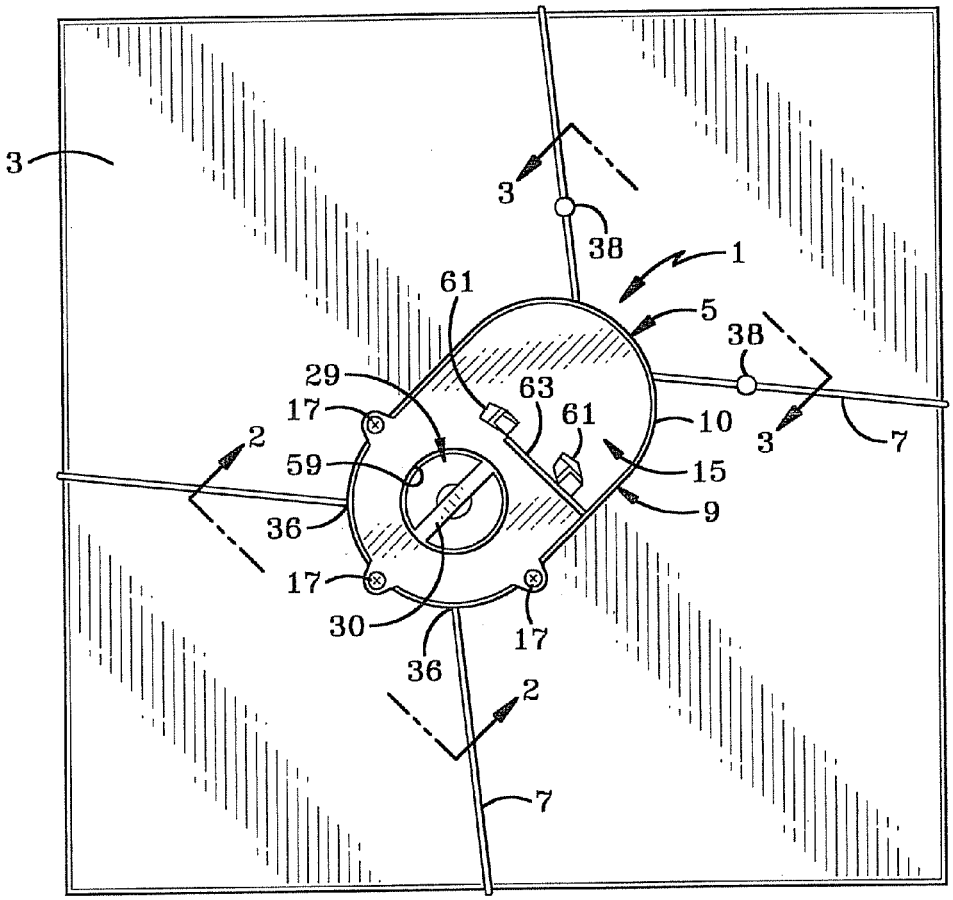
FIG-1
FIG-2
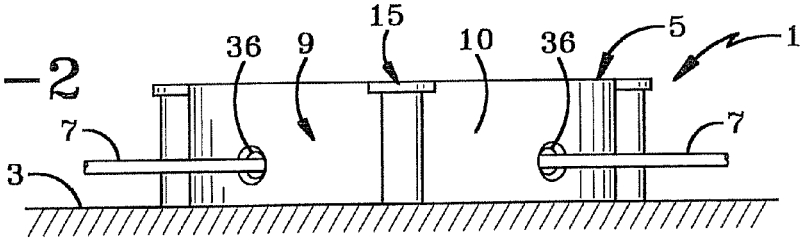
FIG-3
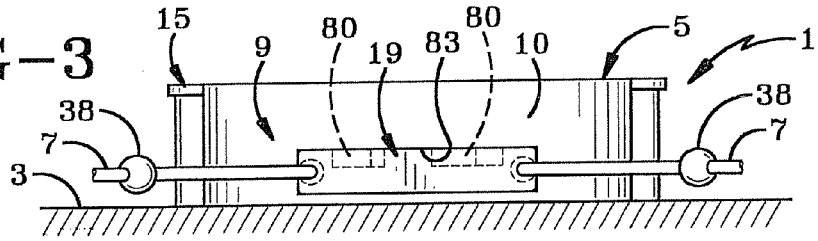

| FIG-4A |
| --- |
| FIG-4B |

| FIG-22A |
| --- |
| FIG-22B |

CABLE WRAP SECURITY DEVICE

CROSS REFERENCE TO RELATED APPLICATIONS

This application is a continuation of U.S. patent application Ser. No. 12/634,875 (U.S. Pat. No. 8,599,022), filed Dec. 10, 2009; which is a continuation of U.S. patent application Ser. No. 12/027,296 (U.S. Pat. No. 8,122,744), filed Feb. 7, 2008; which claims priority from U.S. Provisional Application Ser. No. 60/920,546 filed Mar. 28, 2007; the disclosures of which are incorporated herein by reference.

BACKGROUND OF THE INVENTION

1. Technical Field

The invention relates to a security device, and more particularly to an adjustable security device which wraps around and secures a box-like structure in a secure locked position. Even more particularly, the invention relates to such a cable wrap security device which includes a plurality of cables that wrap around the article to be protected and has an unique mechanism for locking the cable to the device after being placed around the article and for unlocking the cable from the device by a key and a mechanism which automatically retracts the cable onto a spool within the device.

2. Background Information

Retail stores have a difficult time protecting boxes containing various expensive merchandise, books and other similarly structured packages, or protecting such containers from being opened and the contents thereof being removed without authorization from store personnel or damaged while on display. Consumers often want to visually inspect the packaged expensive articles before deciding to purchase them. The store is faced with the problem of how to protect these expensive articles from theft while displaying them for sale.

One method used to protect these packages and the articles contained therein is to enclose the article within a transparent glass display case which can only be accessed by an authorized clerk. The consumer can view the article through the glass but is not able to handle the article or read any of the information about the article that may be printed on the box unless a store clerk removes the article from the case. However, in large retail stores, the problem then arises of getting the selected merchandise to the customer after the customer wishes to purchase the same without subjecting the merchandise to theft. One manner is to maintain a supply of the boxes containing the expensive articles or merchandise close at hand for delivery to or pick-up by the customer for subsequent taking to a check-out clerk. However this makes the boxes susceptible to theft and requires additional sales personnel.

Another method used by retail stores is to list the article in a catalog and require consumers to place an order from the catalog. The article is delivered from a back storage area and the consumer must simultaneously pick up and pay for the merchandise at the same location to prevent unauthorized removal from the store. The consumer does not get to inspect the article before purchasing and if they are not satisfied they must undergo the inconvenience of returning the article for a refund.

Boxes and box-like structures are also subjected to unauthorized openings while being shipped via a courier. These articles can be easily opened and resealed when packaged and taped-shut in the conventional manner without the recipient or the sender knowing of such unlawful actions. Shipped packages can be secured within a security container with a locking mechanism but these containers are expensive to purchase and add size and weight to the package making it more expensive to ship. Also, would-be thieves can gain unauthorized access to the contents of these containers by "picking" the locking mechanisms or possibly guessing the combination to a combination lock.

Some prior art locking devices have adequately solved this problem of securing packages or objects in a closed condition while being displayed in retail stores or shipped from one location to another. Some of these prior art security devices include a wire which wraps around an article and is secured by some type of locking mechanism. For example, see U.S. Pat. Nos. 3,611,760, 4,418,551, 4,756,171, 4,896,517, 4,930,324, 5,156,028, 5,722,266, 5,794,464, 6,092,401 and 7,162,899.

Although many of these prior art cable wrap security devices have proven satisfactory, they may require a special tool to operate the latch mechanism, both for tightening the cable about the object to be protected and to retract the security cable into the device after the security device has been removed from the package. Also some require a mechanism to enable the internal spool on which the cable is wound to be free-wheeling in order for the cable to be pulled outwardly to a larger size for placement around another package.

Also, these prior art devices usually require that the cable be manually rewound onto the spool for storage once the security device has been removed from the package. This requires additional work on the retail personnel, and if the cables are not properly rewound will become tangled with other cables providing a storage problem and requires additional work for reuse and replacement on a package.

Therefore, the need exists for a cable wrap security device which includes a ratchet mechanism and locking member which does not require any special tool to tighten the cable about the package, and in which the lock mechanism locks the cable in position about the object when a clip attached to one end of the cable is inserted into the housing which nearly simultaneously locks the cable spool in a fixed position preventing further movement of the spool until it is manually wound to further tighten the cable about the object.

BRIEF SUMMARY OF THE INVENTION

The security device of the present invention includes a plurality of wires or cables which are intended to encircle and lock all six sides of a box, package, book or other similar structure. The cable extends between a ratchet member which includes a gear with a plurality of teeth, one-way pawls which engage the teeth, a spool which stores the cable and is controlled by the ratchet member, a clip which is attached to a free end of the cable for locking the cable to the device, a locking mechanism which locks the cable clip to the device and secures the cable spool in a fixed position, and which includes and requires a special key to unlock the cable once secured about the object.

Another feature of the present invention is to provide such a security device which requires a special magnetic key to unlock an internal protected locking member to enable the cable to be removed from the protected article.

A further feature of the present invention is to provide the security device with an audible alarm which is actuated should the integrity of a sensing loop in the securing cable be jeopardized or compromised, and in which the security device may contain an EAS tag which actuates an alarm at a security gate should a potential thief attempt to leave the premise before removing the security device from the protected article.

A still further feature of the invention is to provide such a security device which includes a one-way ratchet which is released automatically upon unlocking a cable attachment clip from the lock mechanism by use of a special key.

Another feature of the invention is to provide such a security device in which the locking mechanism is opened by a magnetic release mechanism.

Still another aspect of the invention is to provide such a security device in which the ratchet mechanism is manually operated to tighten the cable about an article by a handle of the ratchet mechanism avoiding the need for a special key to rotate the ratchet mechanism and tighten the cable about the protected article.

Another feature is to bias the cable storage spool by an internal spring in the winding direction so that upon release of the spool and cable attachment clip from the unlocking mechanism, the spool automatically rewinds the cable back onto the spool avoiding exposed dangling cables. This places the security device in a compact condition ready for subsequent use and eliminates exposed cables which can become tangled with other objects, and which avoids the need to manually wind the cable back onto the spool after the cables have been removed from an article.

A further object of the invention is to enable the lock mechanism to be moved from locked to an unlocked position by the unlocking key after placement of the key in a pair of apertures formed in the security device housing or in the locking clip.

Another feature is that the security device has only two cables or cable sections which are attached to the spool and extend from the housing which provides a more conveniently operated mechanism and enables an increased windup tension to be applied to the cable.

Still another aspect of the invention is the spring biased spool which automatically winds up slack in the cable after the cable is placed around the article, afterwhich the cable is tightened manually to a first desired tension.

A further feature is the mounting of the audible alarm adjacent the bottom wall of the housing which is placed adjacent the secured article preventing access thereto by a thief; and in which a slight space is provided between the bottom wall and article to enhance the sound transmission of the audible alarm.

Another aspect of the invention is providing a spool release button which when depressed automatically winds the cable onto the spool enabling a clerk to easily control the movement of the cable.

A still further feature is to provide both flanges of the spool with peripheral teeth engaged by a release lever to enable the spool to withstand greater tension being applied to the cables without failure.

Another feature is to provide the cable attachment clip with means that control a switch on the electronic circuitry of the internal alarm system to deactivate the audible alarm upon removal of the clip from the main housing of the security device.

These features are obtained by the security device of the present invention, the general nature of which may be stated as comprising a housing; a cable for placement about the object; a spool rotatably mounted in the housing and operatively attached to a first end of the cable; a clip attached to a second end of the cable for insertion into the housing to secure the cable about the object; a lock mechanism for locking the clip to the housing; a ratchet mechanism operatively engageable with the spool to maintain the cable tightened about the object; a key for unlocking the clip from the housing; and a retraction mechanism for automatically rotating the spool in the cable takeup direction to wind the cable onto the spool.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

FIG. 1 is a diagrammatic top plan view showing the security device of the present invention secured on a package.

FIG. 2 is a side elevational view looking in the direction of Arrows 2-2, FIG. 1.

FIG. 3 is a side elevational view looking in the direction of Arrows 3-3, FIG. 1.

Similar numbers refer to similar parts throughout the drawings.

DETAILED DESCRIPTION OF THE INVENTION

Figures 4, 4A:
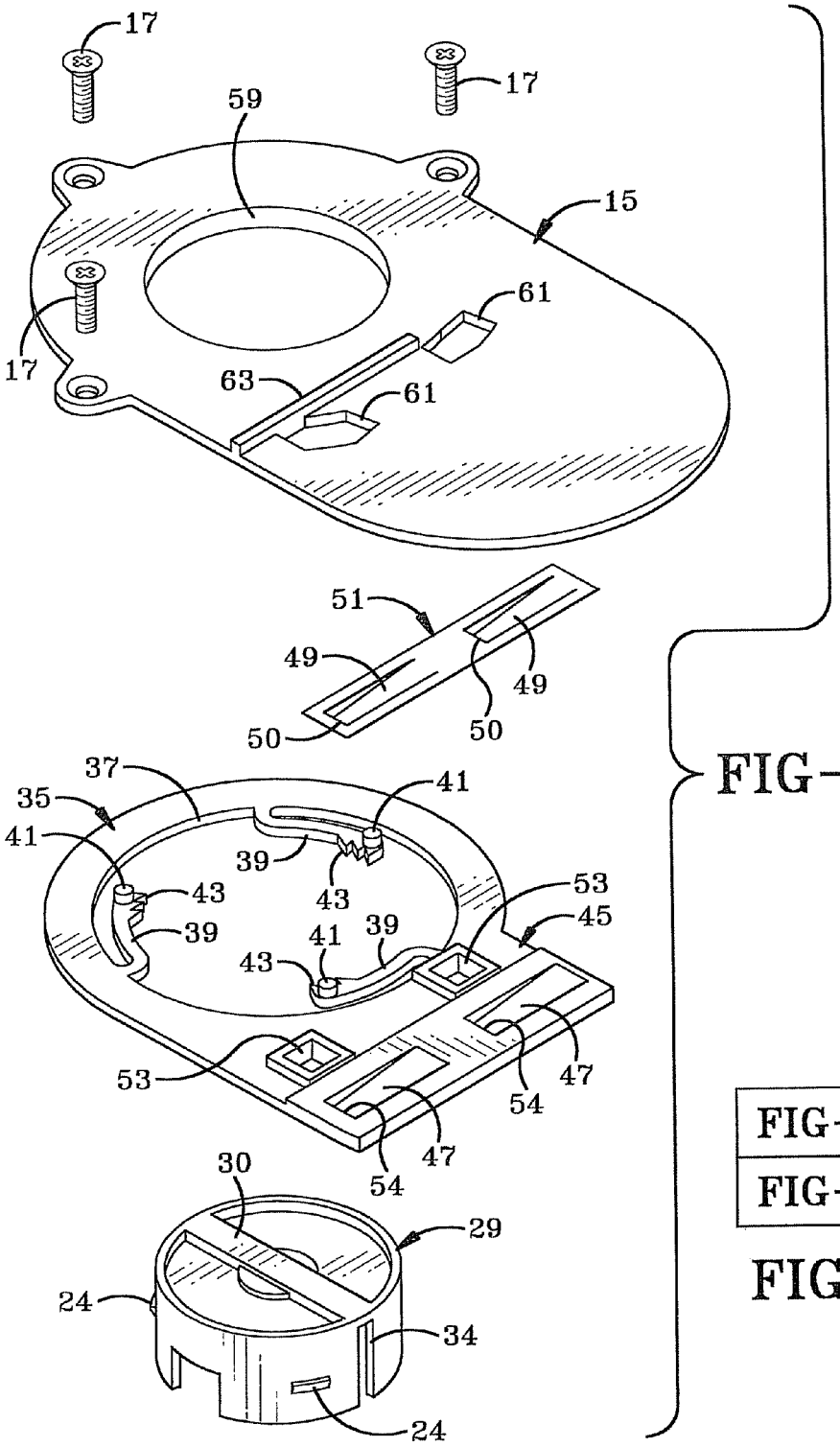
FIG. 4 is a combination of FIGS. 4A and 4B, which are exploded perspective views of the security device.

The security device of the present invention is indicated generally at 1, and is shown in FIGS. 1-3 secured about a package 3. Security device 1 includes a main housing indicated generally at 5 (FIG. 4), and a plurality of cables 7, preferably two, which are stored on an internal spool 8. Housing 5 (FIG. 4B) includes a main housing body 9 preferably formed by an oval shape side wall 10, with an internal spool compartment 11 and a lock compartment 13. Housing 5 further includes a top cover plate 15 (FIGS. 4A and 5) which is secured on the top peripheral edge of the housing body 9 by a plurality of fasteners 17. One end of the double cable 7 is connected to internal spool 8 with the other ends being connected to an attachment clip 19.

Figure 9:
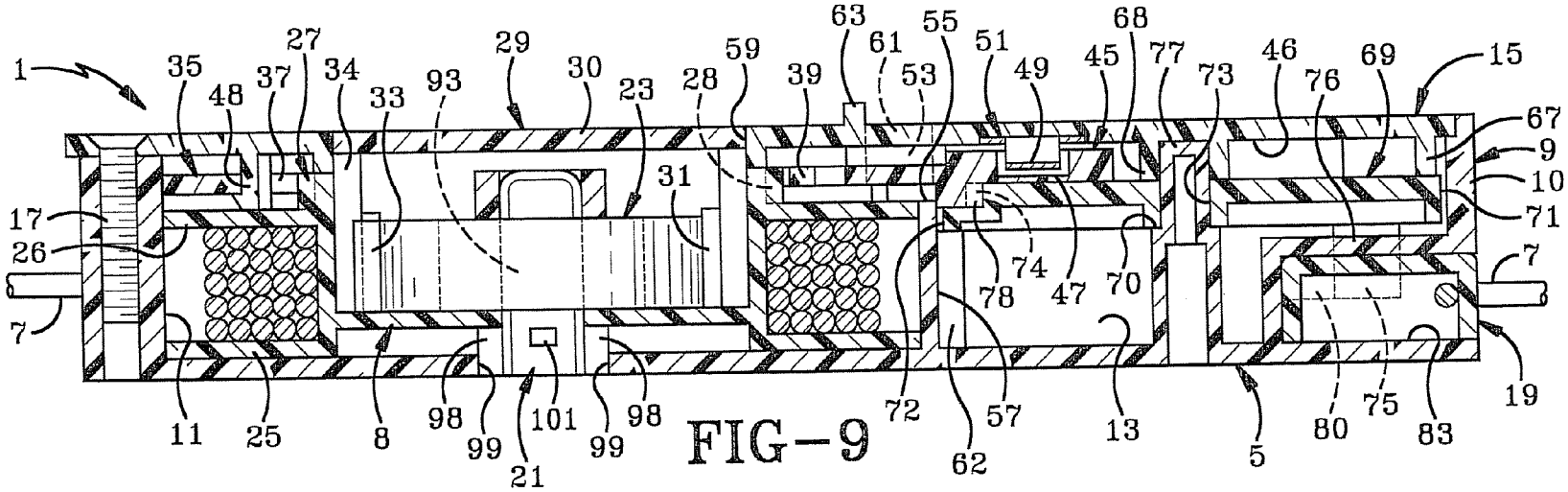
FIG. 9 is an enlarged sectional view taken on line 9-9, FIG. 7.

Cable 7 is stored on spool 8 which is trapped within and rotatably contained within spool compartment 11 formed by oval shaped side wall 10 and curved wall 57, and retained therein by top plate 15. A winder post 21 (FIG. 9) extends through a circular hole 22 formed in spool 8 and is used to pretension a clock spring 23, preferably at the time of manufacture, which provides a bias on spool 8 to rotate it in the winding direction for retracting the cable onto the spool in a storage position as shown in FIG. 9 and discussed further below. Spool 8 has spaced flanges 25 and 26 and an intervening wall 31 which form a cable storage area therebetween. An annular ring 27 of one way gear teeth 28 is mounted on upper spool 26 and forms part of the ratchet mechanism for controlling the rotational movement of the spool within housing 5. Clock spring 23 is located within the annular interior of a tensioning member 29 (FIG. 4A) which includes a cross bar 30 for manually rotating member 29 to tension the cable after being placed about package 3. One end 93 of clock spring 23 is connected to winder post 21 with another end being connected to spool 8. One type of connection may be by a projection 33 (FIG. 4B) attached to spring 23 which extends through a slot 34 formed in the cylindrical side wall of member 29 and into a slotted opening 96 formed in the spool wall 31. Tensioning member 29 is connected to spool 8 by a plurality of snap-fit projections 24 which extend into slots 32 formed in spool 8. Cables 7 exit through a pair of holes 36 formed in side wall 10 of housing body 9 as shown in FIG. 2, and have a pair of positioning ball stops 38 attached thereto.

Figure 10:
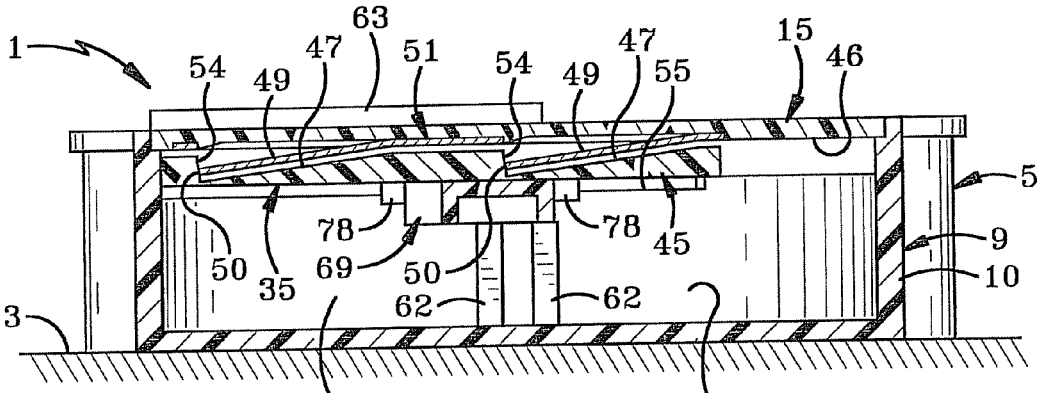
FIG. 10 is an enlarged sectional view taken on line 10-10, FIG. 7 showing the lock mechanism in locked position.

The ratchet mechanism includes a locking disc indicated generally at 35 (FIG. 4A), which has a generally circular configuration at one end formed with a central circular opening 37 into which a plurality of flexible locking pawls 39 extend in an arcuate cantilever fashion. Each locking pawl has a camming projection or post 41 formed on the distal end thereof adjacent a series of gear teeth 43. Locking disc 35 has a generally rectangular-shaped segment 45 at the end of the locking disc opposite end 35 which is formed with a pair of tapered recesses 47 for receiving a pair of locking tines 49 to secure locking disc 35 in the locked position as discussed further below. Tines 49 preferably are formed integrally from a metallic locking strip 51 are biased outwardly therefrom and secure locking disc 35 in a locked non-rotatable position as shown particularly in FIGS. 7, 9 and 10.

Figure 7A:
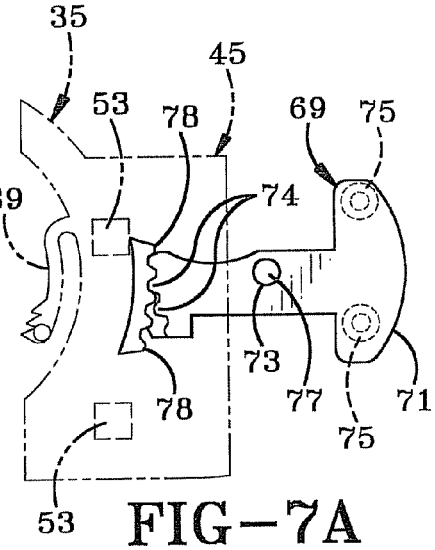
FIG. 7A is a fragmentary view of the pivot arm component of the locking mechanism shown engaged with the locking disc shown in dot dashed lines.
Figure 7:
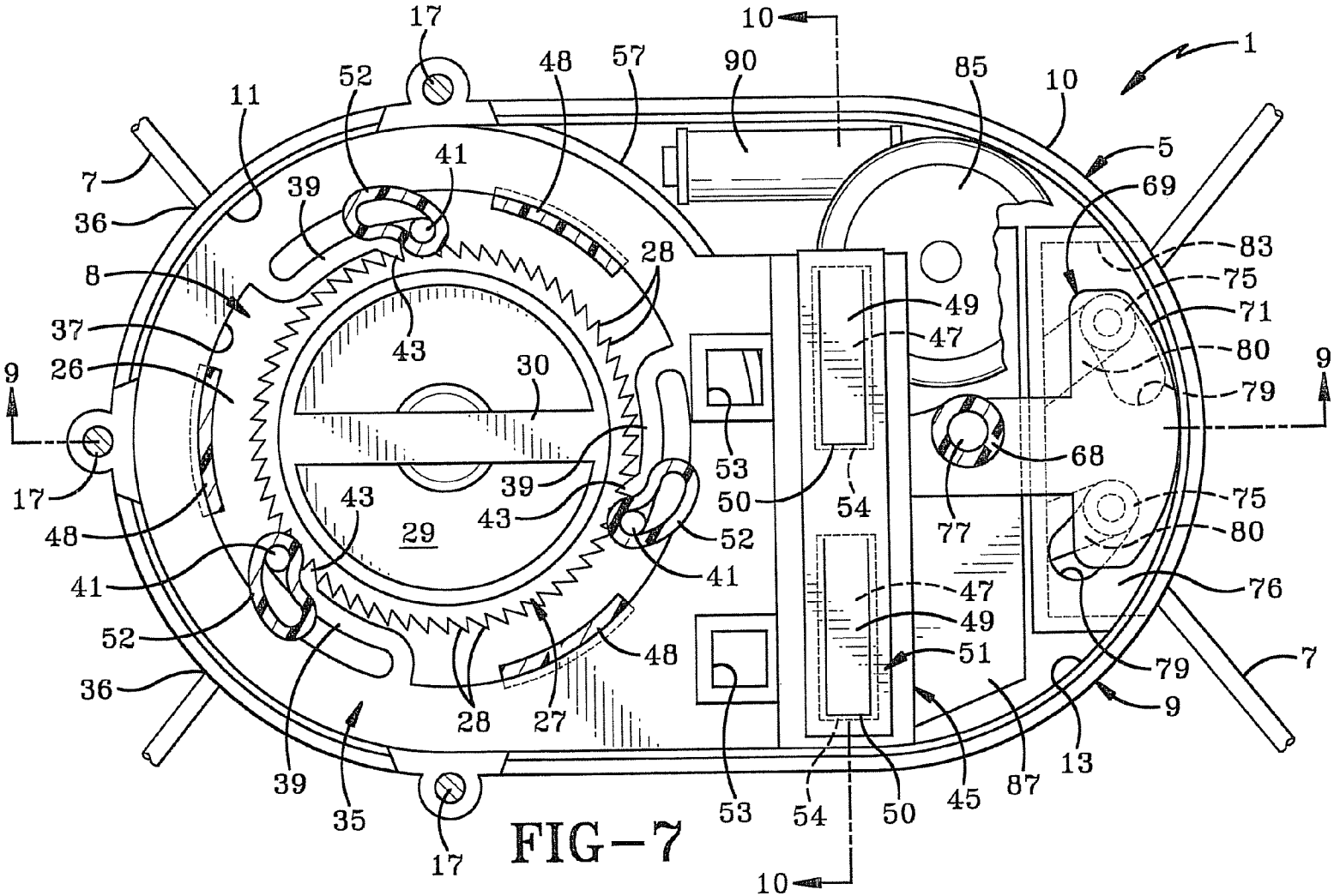
FIG. 7 is a sectional view of the security device in locked position taken beneath the top cover plate.

A pair of rectangular-shaped key-receiving recesses 53 are formed in rectangular end 45 of the locking disc 35, the purpose of which is discussed further below. Locking disc 35 is attached to inside surface 46 of housing cover plate 15 by three curved projections 48 formed on cover plate 15 which snap fit engage the interior periphery of circular opening 37 of the locking disc (FIG. 9). Annular ring 27 of spool 8 extends upwardly through circular opening 37 of locking disc 35 with gear teeth 43 of locking pawls 39 being engageable with gear teeth 28 of ring 27 as shown in FIG. 7 due to the flexible cantilever arrangement of locking pawls 39. Locking disc 35 also rests against three curved bosses 52 which are formed on and project from surface 46 of plate 15 into which posts 41 of locking pawls 39 extend.

Figure 19:
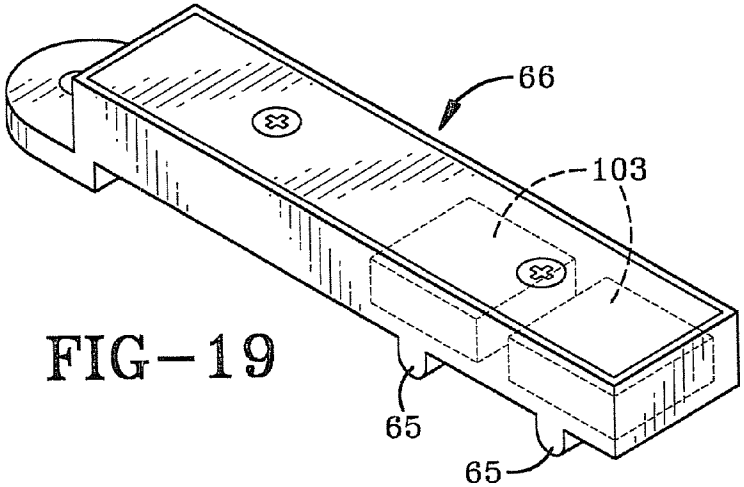
FIG. 19 is a perspective view of the unlocking key.
Figure 13:
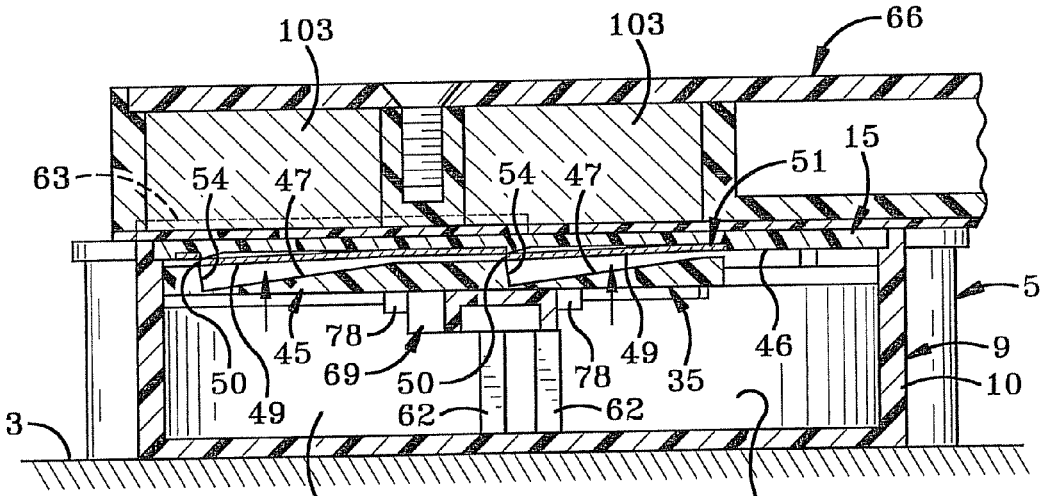
FIG. 13 is a sectional view taken on line 13-13, FIG. 12.
Figure 16:
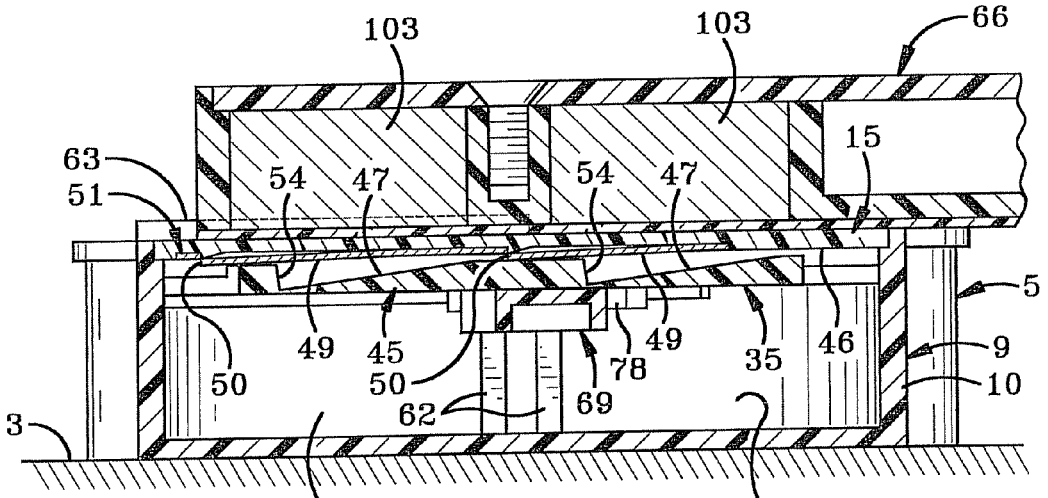
FIG. 16 is a sectional view taken on line 16-16 of FIG. 15, showing the locked mechanism in the unlocked position.
Figure 11:
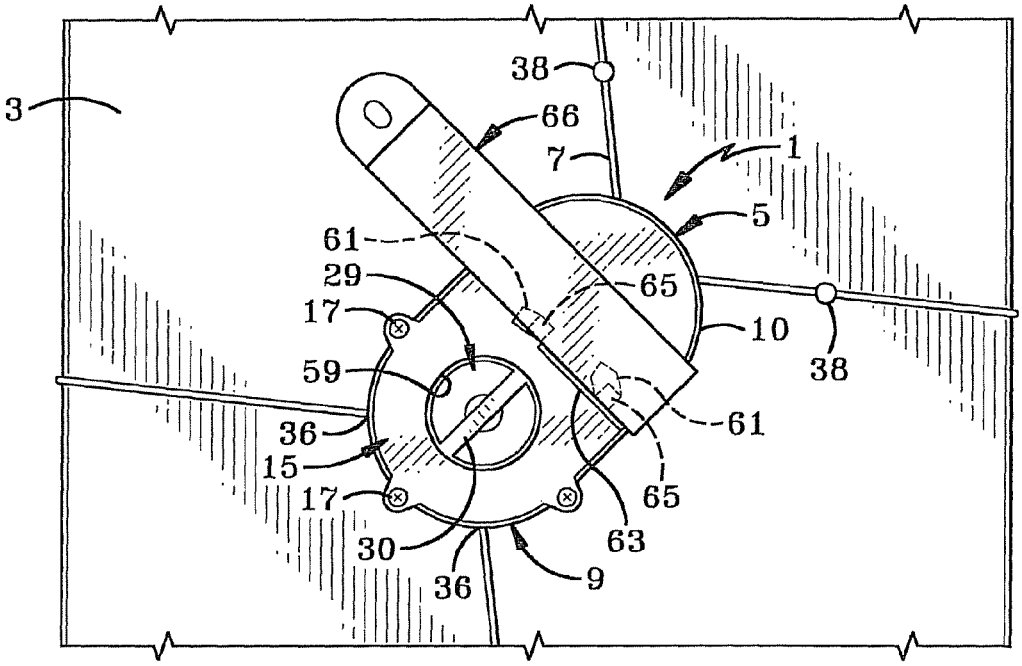
FIG. 11 is a top plan view similar to FIG. 1 showing the unlocking key engaged with the security device.

Housing top cover plate 15 (FIG. 5) is formed with a circular opening 59 for rotatably receiving tensioning member 29 therein providing accessibility to cross member 30. Cover plate 15 also includes a pair of key-receiving slots 61 which have an elongated configuration and which align with key recesses 53 of locking disc 35. A key positioning ledge 63 is formed on the outer surface of cover plate 15 to assist in aligning and positioning a pair of key projections 65 of a magnetic key 66 (FIG. 19) when placed thereon as shown in FIGS. 11 and 13 for unlocking locking tines 49 from locking engagement within recesses 47 of locking disc 35 as discussed further below.

Figure 4B:
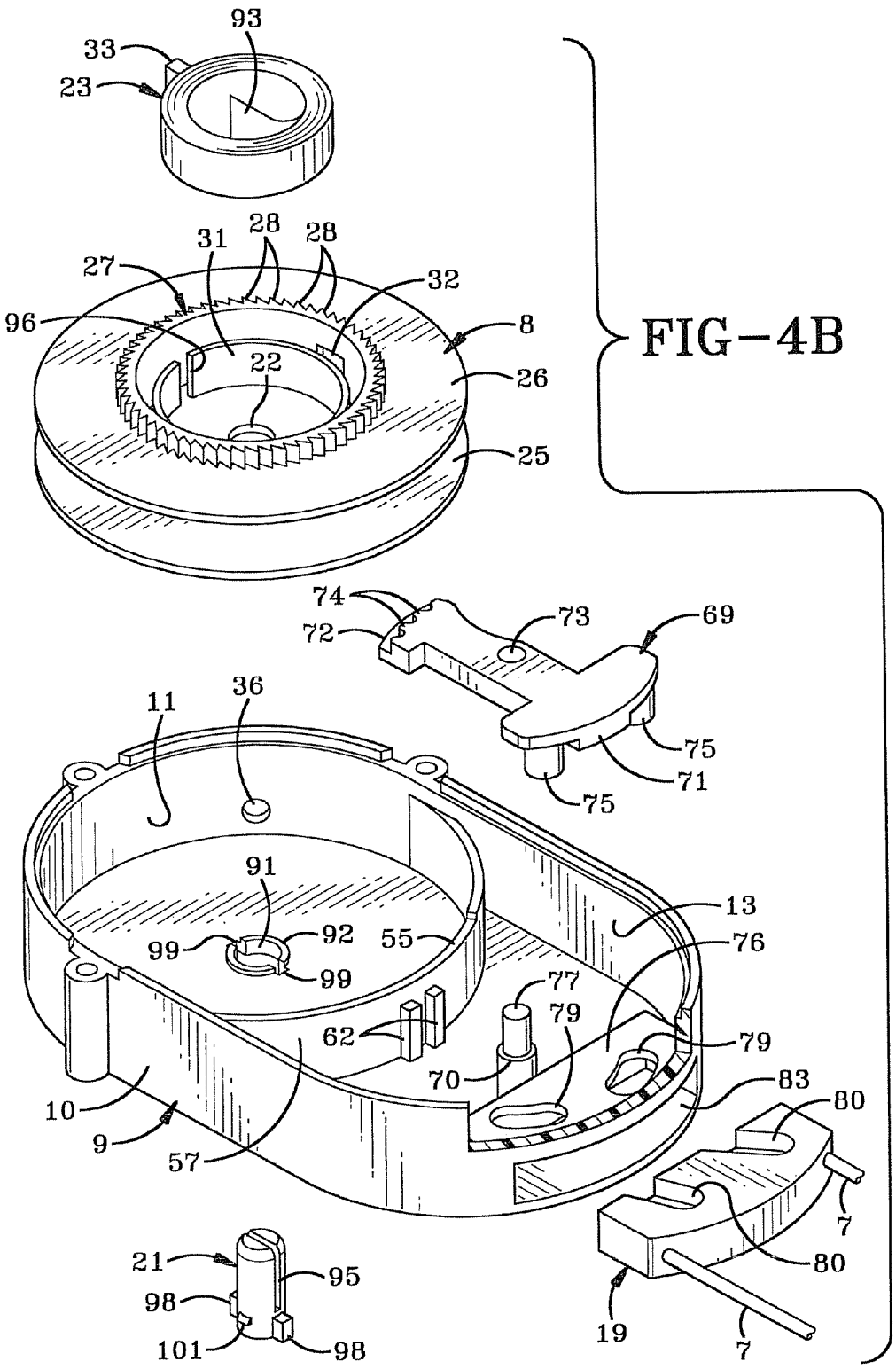
Figure 5:
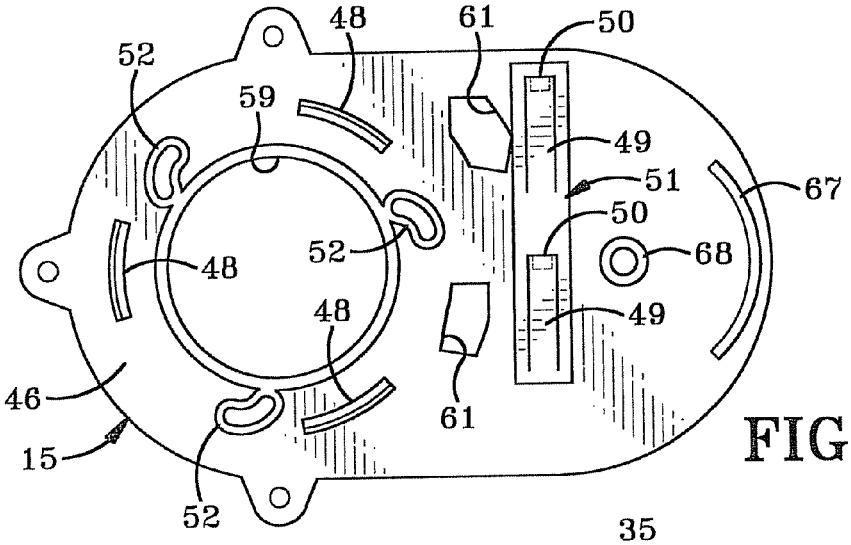
FIG. 5 is a plan view of the inside surface of the housing top cover plate.
Figure 6:
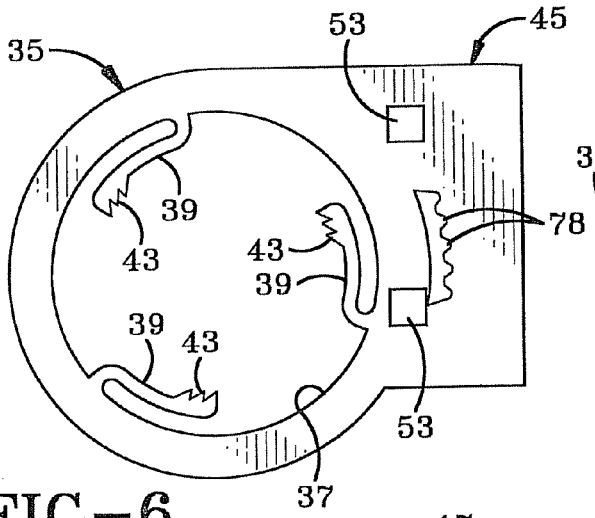
FIG. 6 is a plan view of the underside surface of the locking disc component of the ratchet mechanism.

The unique locking mechanism of the present invention includes a pivotally mounted lock arm indicated generally at 69 (FIG. 4B), which includes a curved end 71 and an opposed end 72 and an intervening pivot 73. End 72 is formed with a arcuate section of ratchet teeth 74 with end 71 being formed with a pair of bosses 75 extending downwardly therefrom. Lock arm 69 is pivotally mounted on the top end of a post 77 located in lock compartment 13 which extends into an opening which forms pivot 73, which when assembled will place ratchet teeth 74 in mating engagement with an arcuate segment of ratchet teeth 78 formed on the bottom surface of end 45 of locking disc 35 as shown in FIG. 6. Lock arm 69 rests upon and is supported by an annular shoulder 70 formed on pivot post 77 and retained in position by an arcuate projection 67 and an annular boss 68 extending from on the inside surface of plate 15 (FIGS. 5 and 9). The extended end of pivot post 77 is received within boss 68. Arm 69 also is supported by a pair of ribs 62 formed along wall 57 (FIG. 4B). Bosses 75 extend through a pair of curved openings 79 formed in a ledge 76 formed adjacent an end of sidewall 9 for releasable engagement with a pair of angled slots 80 formed in an end of attachment clip 19 (FIG. 4B). Attachment clip 19 is adapted to be inserted into an arcuate-shaped opening 83 formed in an end of housing wall 10 when in an engaged locked position for securing the cable about package 3.

Figure 8:
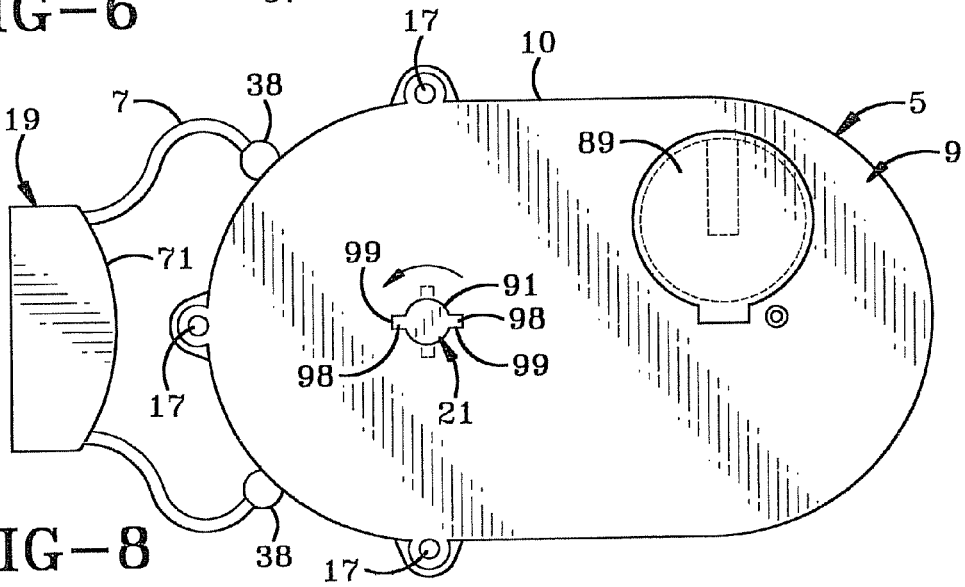
FIG. 8 is a bottom plan view of the security device showing the tensioning of the internal spool tension spring.

As shown in FIG. 7, a piezo alarm 85 is mounted in lock compartment 13 and is operatively engaged with a printed circuit board 87 also mounted in compartment 13 which is powered by a battery (not shown) which is accessible through a battery cover 88 formed in the bottom of housing body 9 as shown in FIG. 8. An EAS tag 90 preferably will be located in lock compartment 13 and operationally connected and controlled by printed circuit board 87.

The alarm system provided by printed circuit board 87 and alarm 85 may implement different types of EAS tags 90 such as acoustic-magnetic (AM), electro-magnetic (EM) and radio frequency (RF) within the concept of the invention. Furthermore, an electrical sense loop will be provided by cables 7 so that should one of the cables be cut or separated from the security device, the alarm system will actuate audible piezo alarm 85. Also, EAS tag 90 is intended to actuate an audible alarm or other signaling device at a security gate should a thief attempt to remove the protected article with the security device attached thereto in an unauthorized manner through the exit protected security gate. The alarm system and components thereof are well known in the security art and thus are not described in further detail.

When in the assembled position, spool 8 is rotatably mounted within housing 5 on winder post 21 and cable 7 is stored thereon with two of the cables extending outwardly through holes 36 (FIG. 2) and terminating at clip 19. Spool 8 is rotatably mounted on winder post 21 which extends through a complementary-shaped hole 91 formed in the bottom wall of housing 5 and through hole 22 in the spool. A pair of arcuate projections 92 (FIG. 4B) surround hole 91 and form a pair of slots 99. Preferably after manufacture and before shipment of tensioning device 1 to a customer, clock spring 23 is pretensioned by winder post 21. One end 93 of clock spring 23 is inserted into a slot 95 formed in winder post 21 with another end of the clock spring being fixed to spool 8 by projection 33 extending through slot 34 of tensioning member 29 and into slotted opening 96 formed on wall 31 of spool 8 as discussed above. Winder post 21 will be partially inserted into hole 91 and spool hole 22 and then rotated a predetermined number of revolutions to pretension clock spring 23 to a desired tensioning force. Post 21 then is inserted fully into hole 91 wherein a pair of wings 98 formed on the bottom of post 21 are inserted into notches 99 to lock post 21 in its final installed position with the desired tension being applied to spring 23 which exerts a predetermined rotational force on spool 8. Once post 21 has been used to tension spring 23 and insert into housing body 9, it will be retained permanently therein by a plurality of one-way snap fit projections 101. Also, when device 1 is fully assembled, camming projections 41 (FIG. 4A) mounted on the ends of locking pawls 39 will extend into the curved recesses 52A formed within the interior of curved bosses 52 formed on the interior surface of cover plate 15. Furthermore, ratchet teeth 74 at the end of lock arm 69 will be engaged with the arcuate segment of ratchet teeth 78 of locking disc 35 as shown in FIG. 7A. One-way gear teeth 43 of locking pawls 39 will be in locking engagement with gear teeth 28 of spool ring 27 when device 1 is in the locked position as shown in FIG. 7, and disengaged therefrom when in the unlocked position of FIG. 15 as described further below.

Figure 17:
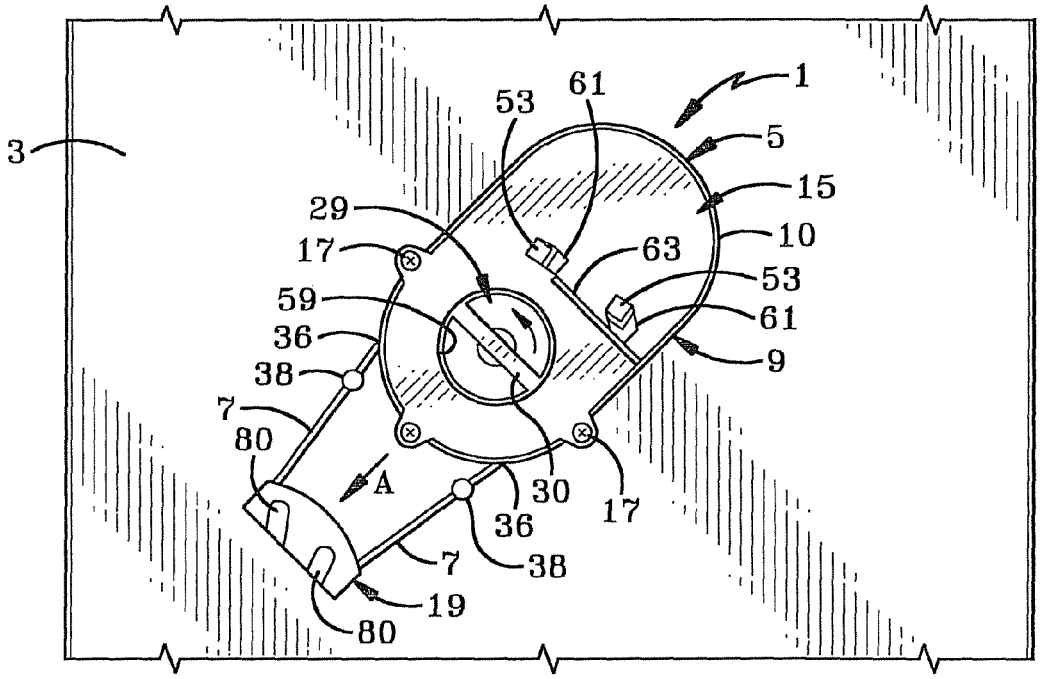
FIG. 17 is a plan view similar to FIG. 1 showing the security device being placed on a package and the cable clip being unwound from the spool for placement about the package.
Figure 18:
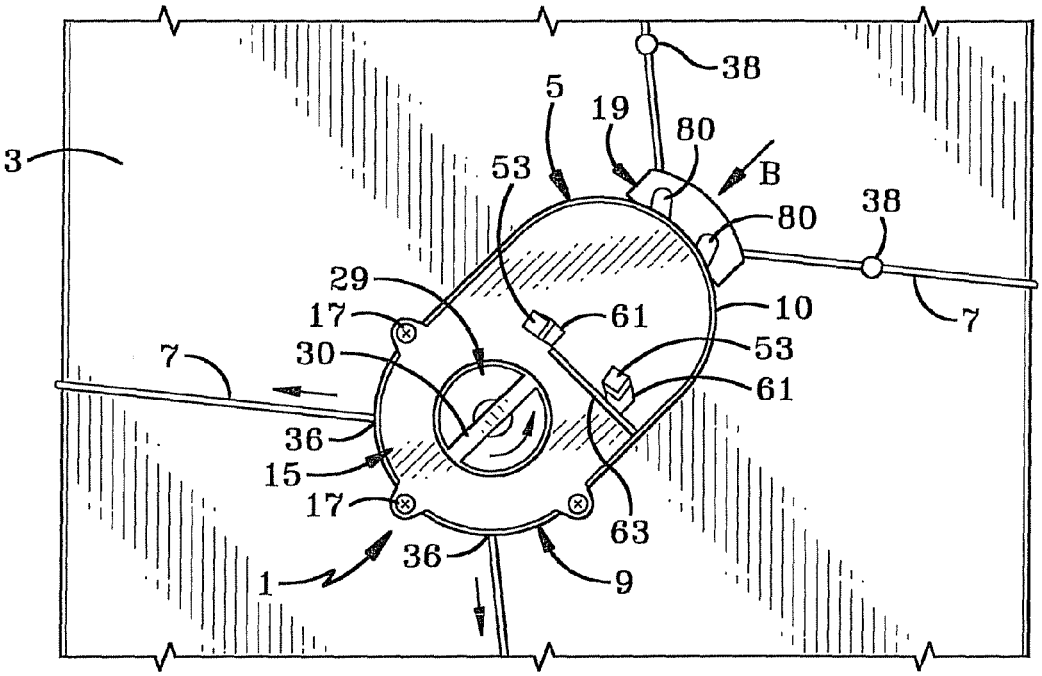
FIG. 18 is a view similar to FIG. 17 showing the cable clip being inserted into the housing of the security device after the cable is placed about the package.

The manner of operation of the improved cable wrap security device of the present invention is best shown in FIGS. 7-18. When in the unlocked and unattached position as shown in FIG. 17, spool 8 will be free wheeling in the unwind direction. A clerk will pull outwardly on clip 19 as shown by Arrow A, which will unwind cable 7 from about spool 8. The cable is placed about the corners of the package until clip 19 reaches the position as shown in FIG. 18 where the clip is at the entrance of end slot opening 83. A clerk will insert clip 19 into opening 83 as shown by Arrow B, which will cause bosses 75 of lock arm 69, which are aligned with the entrances to angled slots 80 of clip 19, to move in an angular fashion along angled slots 80. This movement will cause lock arm 69 to pivot about pivot 73 causing ratchet teeth 74 which are engaged with arcuate ratchet teeth 78 (FIG. 7A) to rotate locking disc 35 sufficiently to move gear teeth 43 into engagement with spool teeth 28 due to the movement of posts 41 within curved bosses 52. This results in clip 19, bosses 75 and ratchet teeth 43 to assume the locked position as shown in FIG. 7. Locking tines 49 will automatically move from the unlocked position of FIG. 16 into the locked position of FIG. 10 wherein the distal ends 50 will enter into recesses 47 and into abutting engagement with shoulders 54 at the end of recesses 47.

When in this locked position of FIG. 7, clip 19 is prevented from being disengaged from housing 5 due to the angular position of locking arm bosses 75 and angled slots 80. Arm 75 is prevented from further movement due to the engagement of ratchet teeth 74 with ratchet teeth 78 of locking disc 35, since disc 35 is prevented from further movement due to the engagement of locking pawl gear teeth with the one-way gear teeth 28 of spool 26 and locking tines 49 engaged in recesses 47. Locking arm 69 is prevented from movement since it is secured at one end by clip 19 and at the other end by ratchet teeth 74, which in turn positively engages pawl teeth 43 of locking disc 39 with spool teeth 28. The engagement of pawl teeth 43 with spool teeth 28 prevents any further rotation of the spool in the cable discharge or unwind direction.

The clerk then will rotate disc spool 8 in the tensioning direction by manual rotation of tensioning member 29 by grasping and turning cross member 30. Usually only a slight turn of member 30 will be sufficient to further tighten the cable about the package by retracting the cable into the security device and about spool 8. When in this secured position, the internal alarm and sense loop provided through cable 7 will prevent unauthorized severing of the cable and prevent the unauthorized removal of the protected package through the security gate because of the presence of EAS tag 90.

Figure 14:
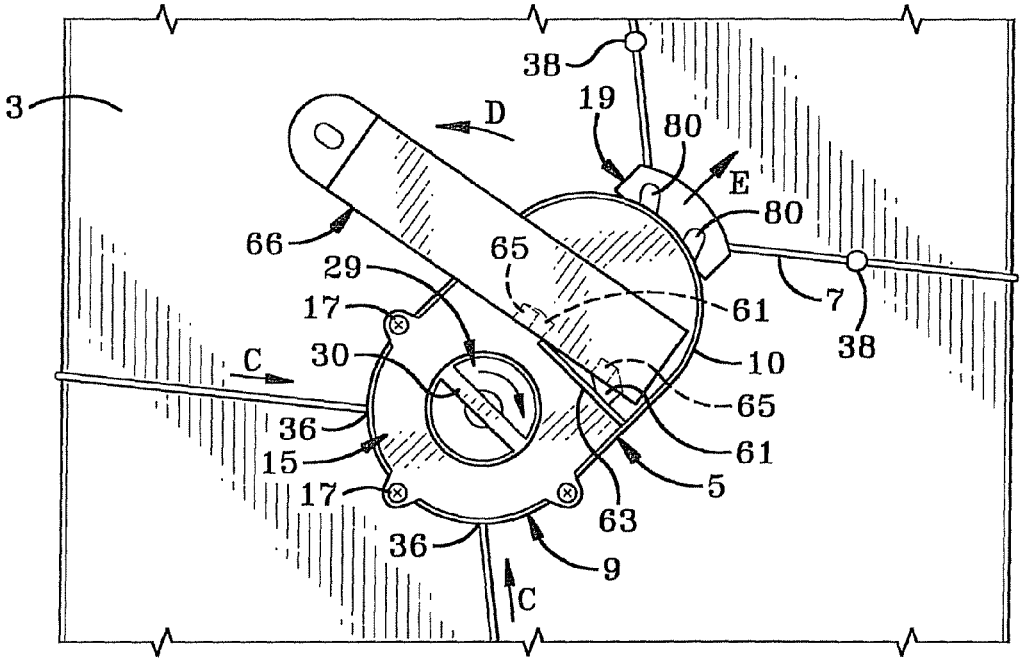
FIG. 14 is a top plan view similar to FIG. 11 showing the unlocking key being moved to the unlocked position.
Figure 12:
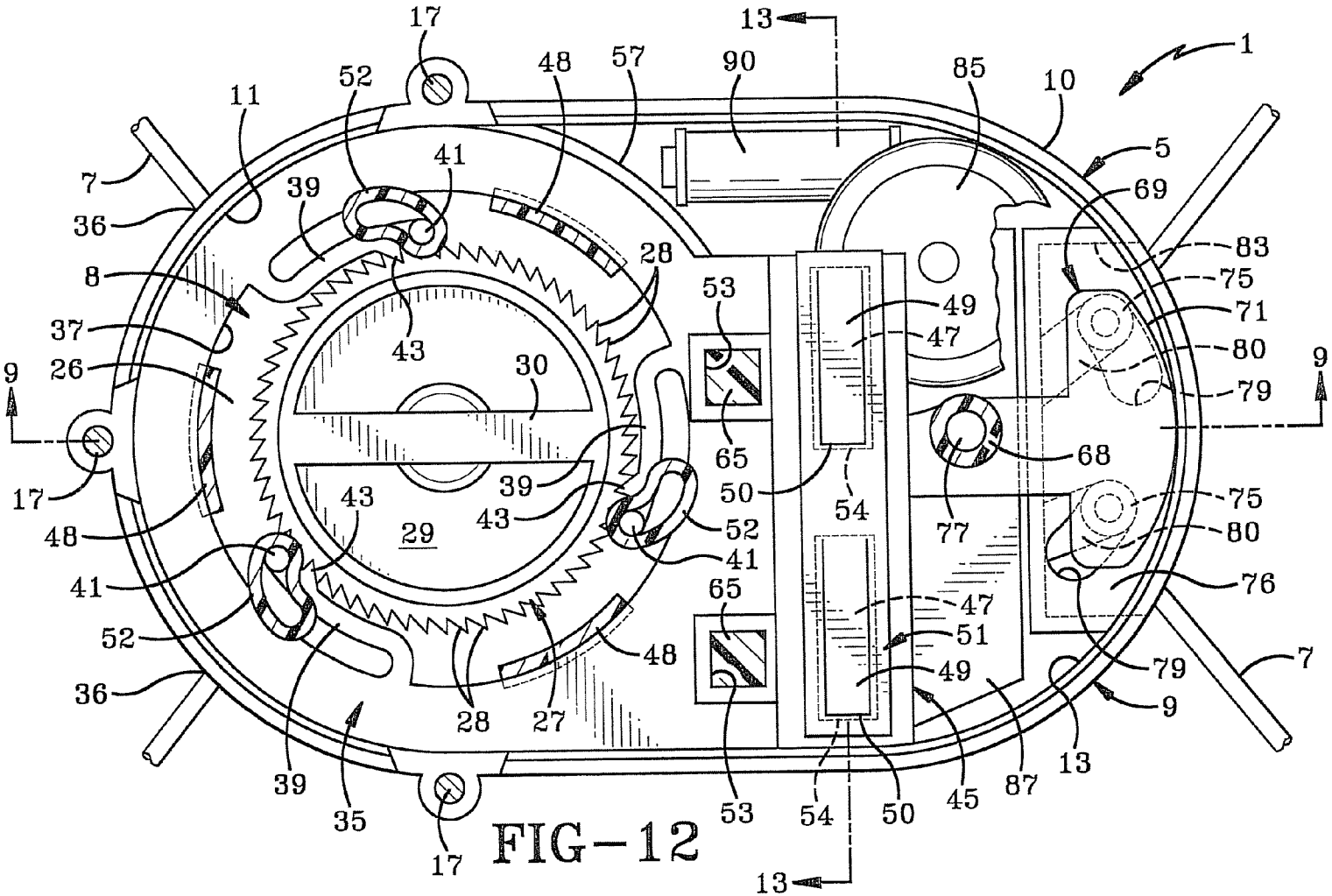
FIG. 12 is a sectional view similar to FIG. 7 showing the locking mechanism in the locked position with the key engaging the lock mechanism just prior to the key being moved to the unlocked position.

To remove security device 1 from package 3, a clerk will place key 66 against key positioning ledge 63 and place projections 65 through elongated slot 61 and into recesses 53 of locking disc 35 which will align a pair of internal magnets 103 with each of the locking tines 49. See FIGS. 11 and 13. The locking tines will be attracted to magnets 103 and move out of engagement within recesses 47 from the locked position of FIG. 10 to the unlocked position of FIG. 13. The operator then merely moves the key a very slight amount along cover plate 15 as shown by Arrow D, FIG. 14, with key projections 65 moving slightly along slotted openings 61. The engagement of key projections 65 in recesses 53 will rotate locking disc 35 and disengage pawl teeth 43 from spool ratchet teeth 28 since camming projections 41 will move through curved bosses 52 completely disengaging the pawl teeth from spool teeth 28 as locking disc 35 rotates slightly in a counterclockwise from the position of FIG. 12 to that of FIG. 15. This movement will pivot lock arm 69 in a clockwise direction due to the engagement of ratchet teeth 74 with ratchet teeth 78, which will in turn cause bosses 75 to move from their locked position within clip slots 80 to the unlocked position of FIG. 15. This movement also moves locking strip 51 and locking tines 49 from the unlocked position of FIG. 13 to the position of FIG. 16 where the locking tines are prevented from being biased back into recesses 47 since they have been placed out of alignment with the recesses. Upon reaching the unlocked position as shown in FIG. 12 and FIG. 14, the bias exerted by clock spring 23 will rotate spool 8 in the cable retraction or cable takeup direction causing the cable to move inwardly in the direction of Arrow D as shown in FIG. 14 which will automatically rotate spool 8 from the position of FIG. 12 to that of FIG. 15. Thus the retraction tension exerted on cable 7 by spring 23 will automatically pull clip 19 from within housing 5 in the direction of Arrow E (FIG. 14) when tines 49 are lifted from within recesses 47 and locking disc 35 is moved slightly by key projections 65 disengaging the clip from within the housing. The retraction tension exerted by the spring will continually rotate spool 8 in the retraction direction enabling the previously extended cable to be automatically retracted into its stored position on spool 8 such as shown in FIG. 17.

The reverse of these steps occur when clip 19 is reinserted into housing body 9 through arcuate opening 83 as shown by Arrow B, FIG. 18, which as described above will pivot locking arm 69 through the action of bosses 75 in clip slots 80. Again, this movement will slightly rotate locking disc 35 due to the engagement of gear teeth 74 with gear teeth 78 on the locking disc as shown in FIG. 7A, which in turn cause pawl teeth 43 to engage spool teeth 28 by the movement of locking pawl bosses 41 in the arcuate recesses of bosses 52 formed on housing top cover plate 15. This movement of locking disc 35 will then move locking strip 51, and in particular locking tines 49 from the position of FIG. 16 to that of FIG. 13, where due to the natural spring bias of the locking tines will automatically move into recesses 47 wherein distal ends 50 engage recess shoulders 54 placing the various members in a secured locked position until the locking tines are again moved out of the recesses by the use of key 66 from the position of FIG. 10 to that of FIG. 16.

Thus, the locking device of the present invention provides for a cable wrap security device which is easily placed in a secured locked position about a package by pulling the cables out of their retracted position within the device overcoming the biasing force exerted by clock spring 23. The locking device automatically becomes locked by insertion of clip 19 into housing 5, as well as automatically actuating the ratchet mechanism preventing rotation of the spool and consequently the attached cable in a payout or unwind direction. Furthermore, slight manual rotation of the exposed end of tensioning member 29 will further retract the cable by winding spool 8 in a further cable takeup direction until the desired tension is achieved on the cable about the package to prevent its removal from about the package until the device is unlocked by a special key, such as magnetic key 66. Also due to the alarm system and the sense loop provided through the cables, together with the EAS tag secured and concealed within the security device, tampering of security device 1 is prevented by the use of audible alarm 85, as well as the use of the EAS tag to prevent removal of the entire package and attached device through a secured exit.

Figure 20:
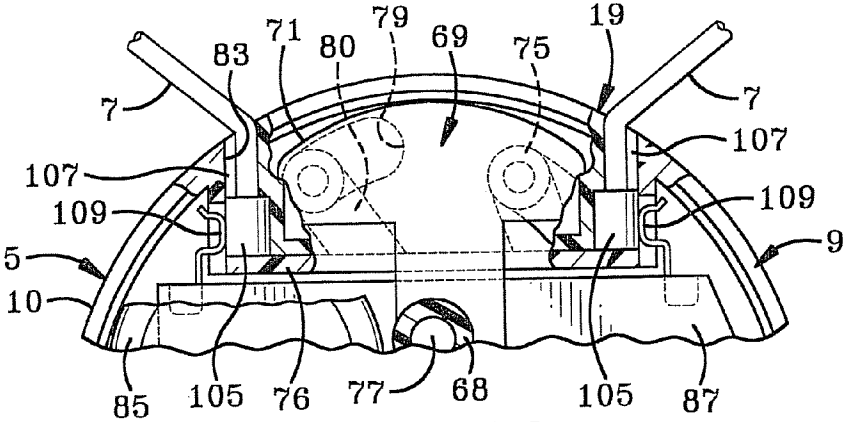
FIG. 20 is a fragmentary top plan view with portions broken away showing a modified embodiment of the cable attachment clip connection.
Figure 15:
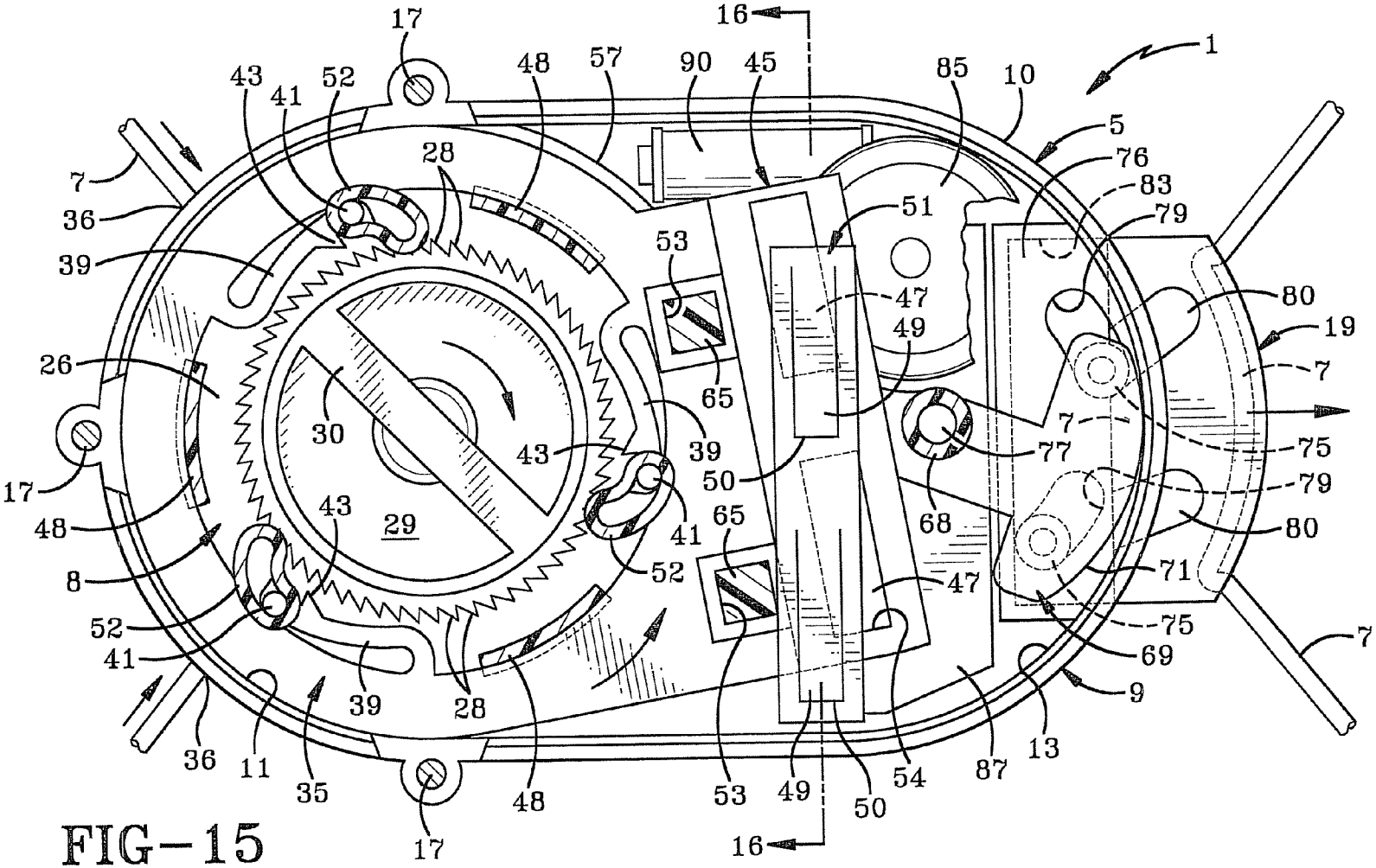
FIG. 15 is a sectional view similar to FIG. 12 showing the locking mechanism in the unlocked position and the ratchet mechanism and cable clip in disengaged positions.

FIG. 20 shows an alternate embodiment of the connection of cable 7 with clip 19 wherein a first embodiment is shown particularly in FIG. 15. As shown in FIG. 15, cable 7 merely forms a continuous loop through clip 19, which although providing a strong mechanical connection between the cable and the clip, does not provide the additional security as that provided by the alternate connection of cable 7 to clip 19 as shown in FIG. 20 and described below. As shown in FIG. 20, cable 7 is two separate cables, each of which terminates in a slightly enlarged connector 105, which may be press fitted on the ends of the cable which are received and retained within slots 107 formed in both sides of clip 19. Cable connectors 105 are each engageable with a spring clip 109 which provides an electrical terminal through its connection to the appropriate circuitry formed on printed circuit board 87. Thus, when clip 19 is inserted through or into end opening 83 of housing 9, cable terminal connectors 105 will mechanically engage spring clips 109 completing an electrical circuit through printed circuit board 87. Thus, should clip 19 be forcibly pulled out from housing 9, it will disrupt the electrical continuity established through printed circuit board 87 causing alarm 85 to sound, notifying the store personnel that an unauthorized event has occurred.

It is readily understood that some type of pressure switch, magnetic switch, etc. (now shown) will be incorporated into security device 1 and the alarm circuitry of the printed circuit board to deactivate the alarm upon lawful opening of the lock mechanism and removal of clip 19 from body 9 to prevent the alarm from sounding.

It is readily understood that other types of security keys could be utilized instead of magnetically attracting locking tines if desired, without affecting the concept of the invention. Also, various types of manually actuated winding devices and spring mechanisms could be utilized than the particular clock spring 23 and tensioning member 29 as shown and described above.

A modified security device of the present invention is indicated generally at 110, and is shown particularly in FIGS. 21-40. Modified security device 110 includes a main housing indicated generally at 113, comprised of an upper housing member 114 and a bottom housing member 115 which can be joined to together by adhesives, sonic welding etc. to form an internal chamber having a spool compartment 116 in which is rotatably mounted a cable spool 117, and a lock compartment 118. Top housing member 114 is shown particularly in FIG. 22A and has an elongated configuration with a main circular opening 119 in which is rotatably mounted a winder mechanism 121. Winder mechanism 121 is operationally connected to cable spool 117 by a plurality of projections 122 formed on spool 117 and extending into notches 123 formed in the periphery of an annular flange 125. Winder mechanism 121 includes the outer substantially annular flange 125 which is located beneath a downwardly extending annular projection 127 surrounding housing opening 119 (FIG. 38) to retain winder mechanism 121 within spool compartment 116 of housing 113. Winder mechanism 121 includes a flip-up handle 129 which is pivotally mounted by a pair of pivot pins 130 on the main disc-shaped body portion 131 of the winder mechanism. Winder mechanism 121 is secured to cable spool 117 by projections 122 so as to be rotatable therewith.

Figure 38:
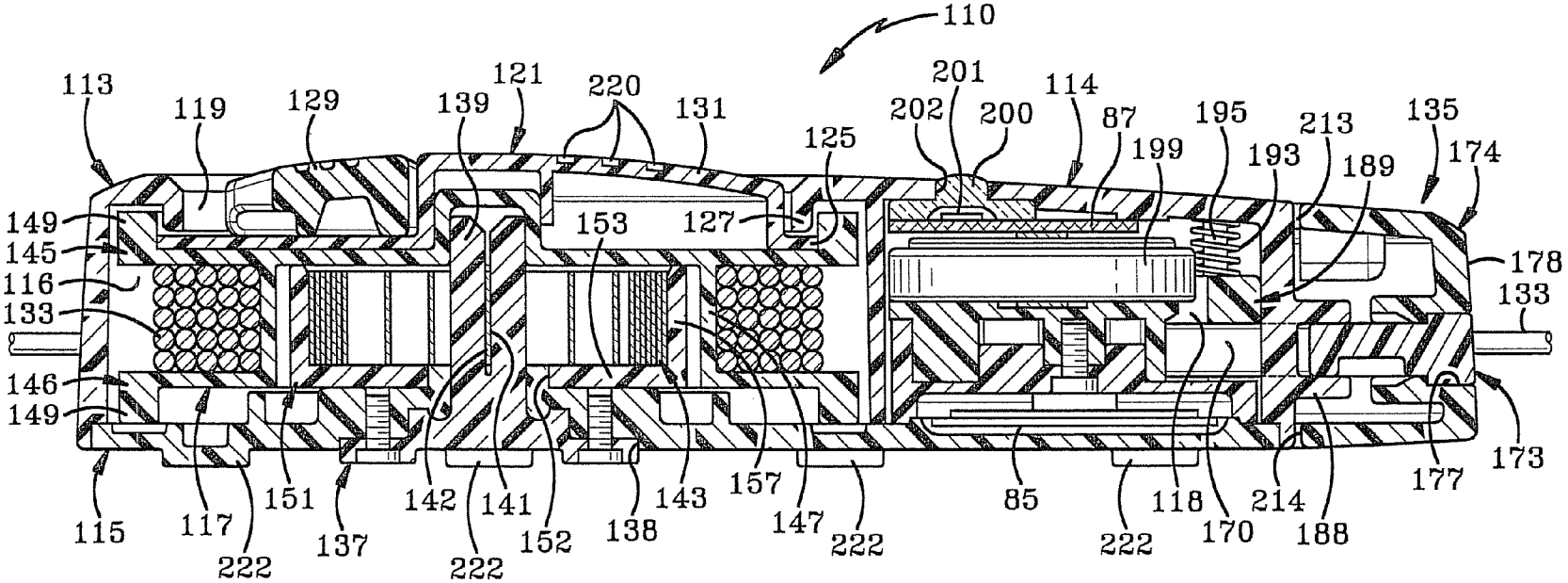
FIG. 38 is a sectional view taken on line 38-38, FIG. 36, showing the clip in a fully locked position within the housing and the cable in a wound position about the spool.
Figure 39:
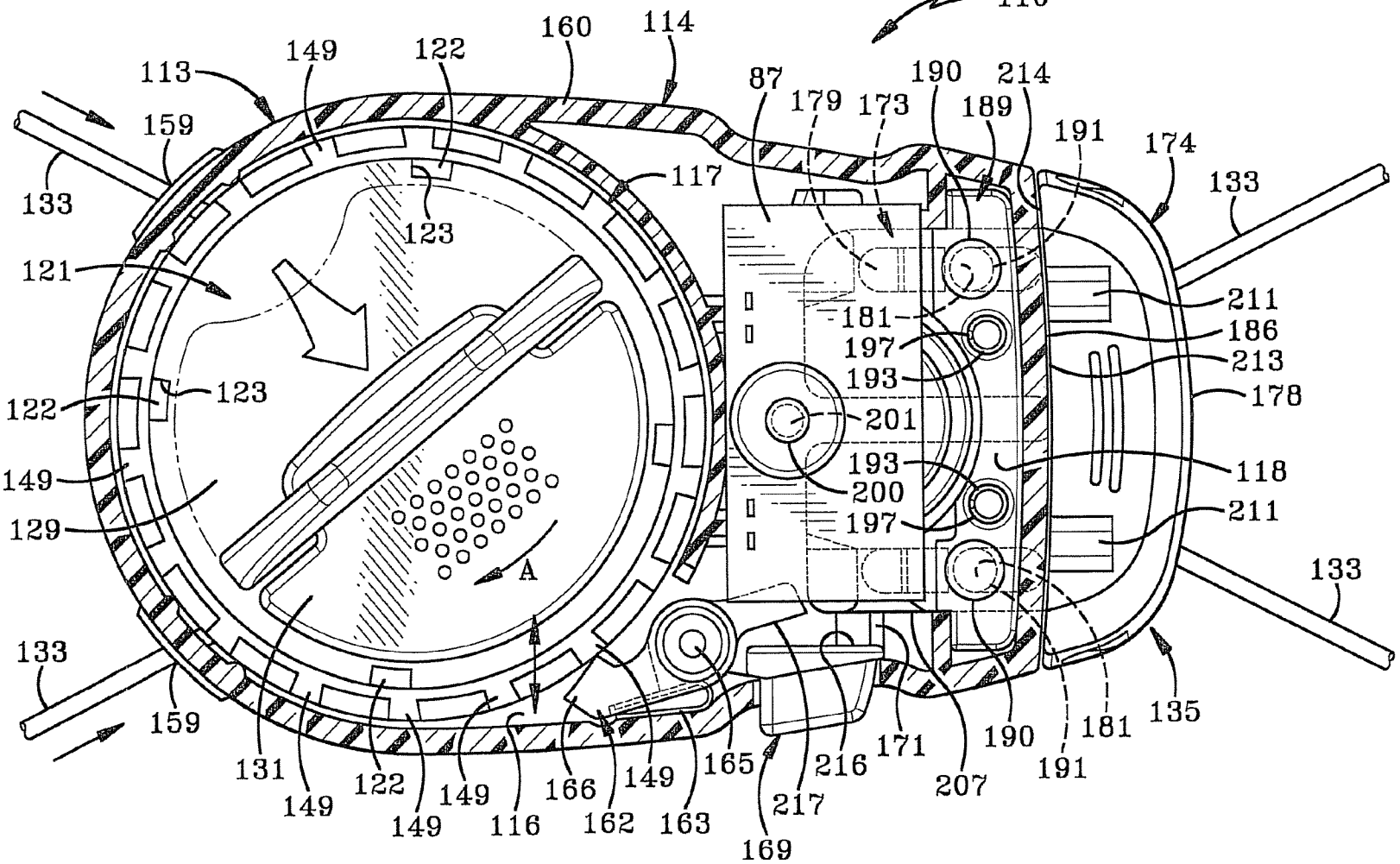
FIG. 39 is a top plan view with portions in section showing the actuation button in a depressed condition and the spool winding the cable into the housing.

A cable 133 which could be a single loop or a pair of cables is connected to spool 117 with the other cable ends being connected to an attachment clip indicated generally at 135. Cable 133 is stored on spool 117 which is rotatably mounted within spool compartment 116 on a post 139 extending upwardly from a circular plate 137 (FIGS. 22B, 24 and 38) which is mounted in a circular hole 138 formed in bottom housing member 115. Post 139 is formed with a slot 141 in which an end 142 of a coil spring 143 is secured which provides a biasing force on spool 117 to rotate the spool in the winding direction to retract the cable onto the spool into a stored position as shown in FIGS. 38 and 39 and discussed further below. Spool 117 has spaced flanges 145 and 146 (FIGS. 22B and 25) and an intervening wall 147 which forms a cable storage area therebetween. The use of only two cables or cable loops attached to spool 117 and exiting housing 113 is an improvement over prior cable security devices such as shown in U.S. Pat. No. 5,722,266 which has four cable loops or sections exiting the housing. This reduces tangling of the cable and enables a greater takeup tension to be placed on the two cable loops than possible on the four cable loops when manually rotating the spool after placement of the cable about the object.

A plurality of notches 144 may be formed in wall 147 for securing cable 133 to the spool. A plurality of gear teeth 149 preferably are formed on the outer periphery of both spool flanges 145 and 146 and form part of a ratchet mechanism for controlling the rotational movement of spool 117 within spool compartment 116. Coil spring 143 is seated within a cylindrical spring holder 151 (FIG. 29) which has a center hole 152 formed in a bottom wall 153 through which spool post 139 extends as shown in FIG. 38. Holder 151 is clamped against housing bottom member 115 by spool flange 145. A second end 155 of spring 143 is inserted into a slot 156 formed in spring holder sidewall 157 (FIG. 22B) to secure spring 143 to spring holder 151. Winder mechanism 121 as discussed above is fixed to spool 117 and is manually rotated as discussed further below, by the use of flip-up handle 129 for rotating spool 117 in a clockwise direction as shown by Arrow A in FIG. 33 to tighten cable 133 about a product after retracting the cable into housing 113 by the biasing force of spring 143. Cable 133 exits housing 113 through a pair of holes 159 formed in one end of elongated sidewall 160 of top housing member 114.

Figure 28:
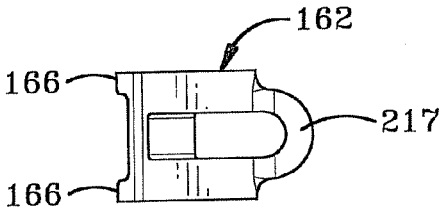
FIG. 28 is a top plan view of the locking lever of the locking mechanism of the modified security device.
Figure 29:
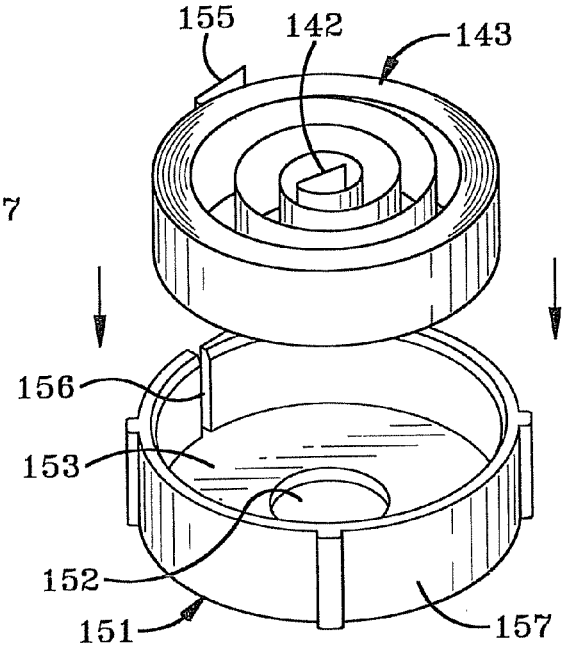
FIG. 29 is an exploded perspective view of the coiled tensioning spring removed from its holder.
Figure 30:
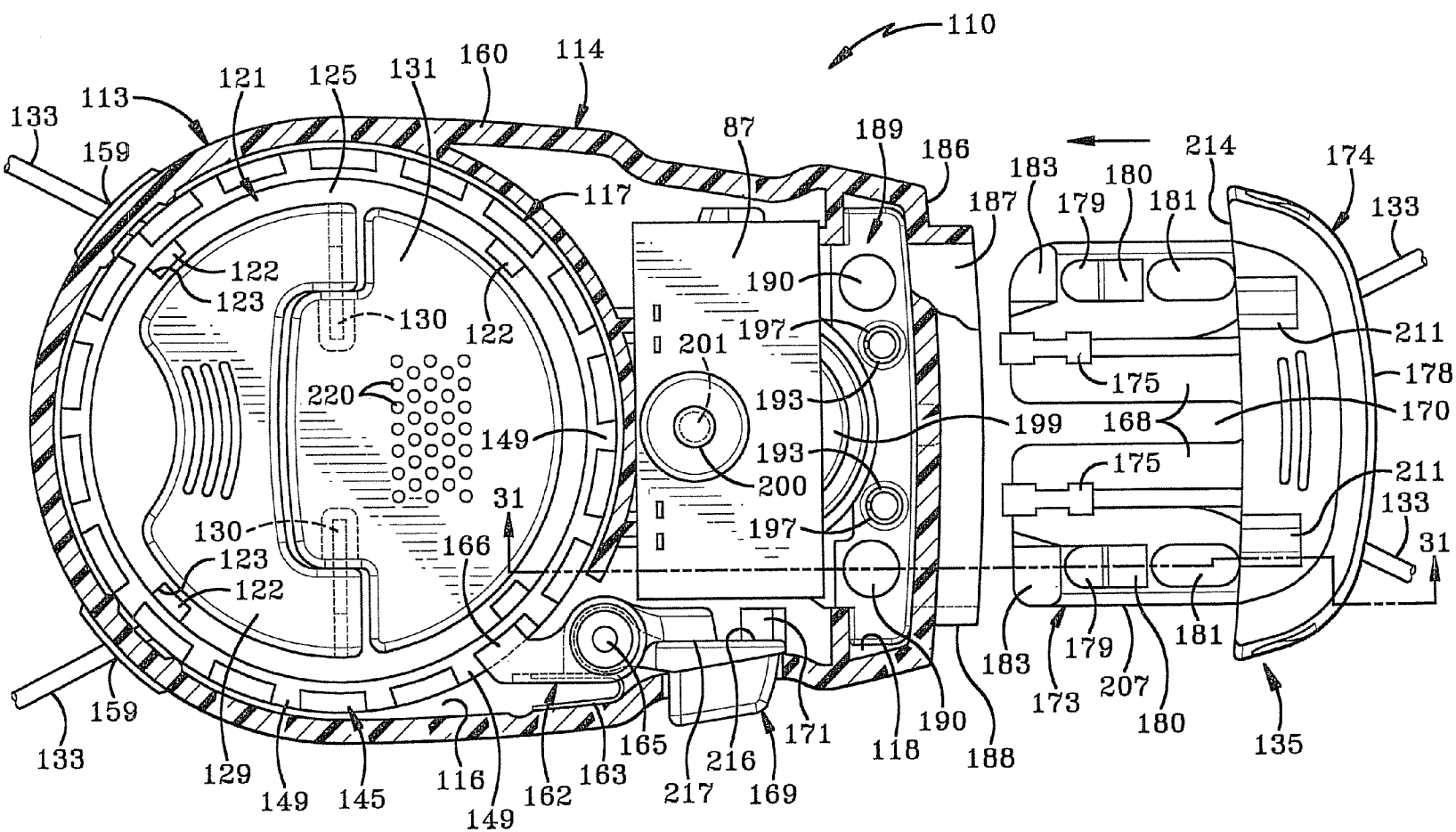
FIG. 30 is a top plan view of the security device of FIG. 21 with the locking clip being disconnected from the housing.
Figure 31:
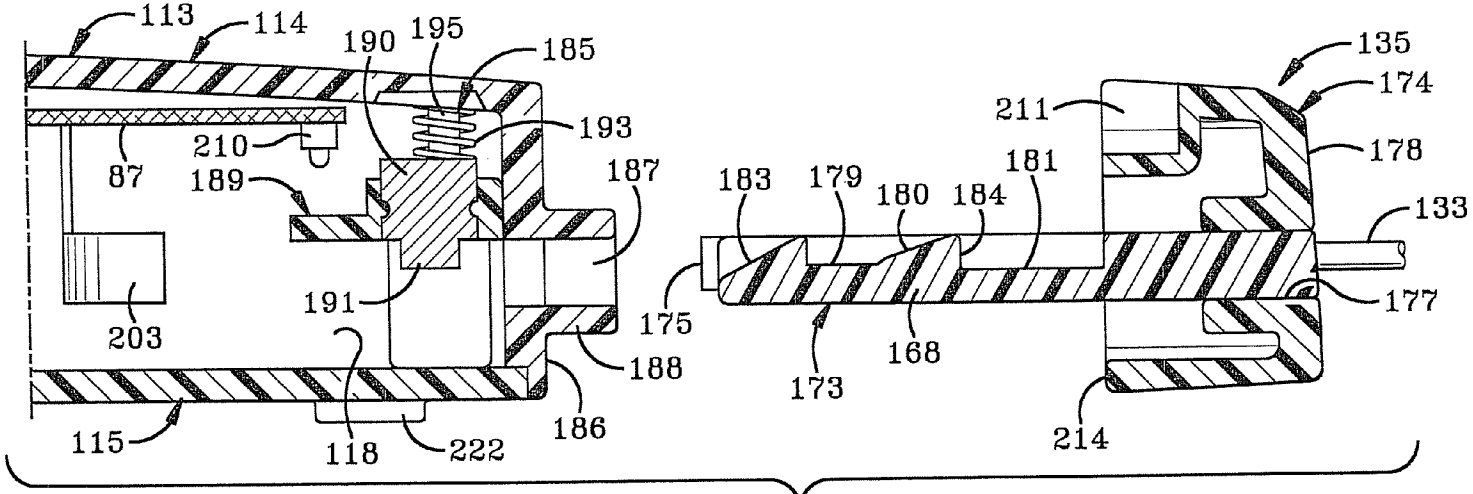
FIG. 31 is an enlarged fragmentary sectional view taken on line 31-31, FIG. 30.
Figure 32:
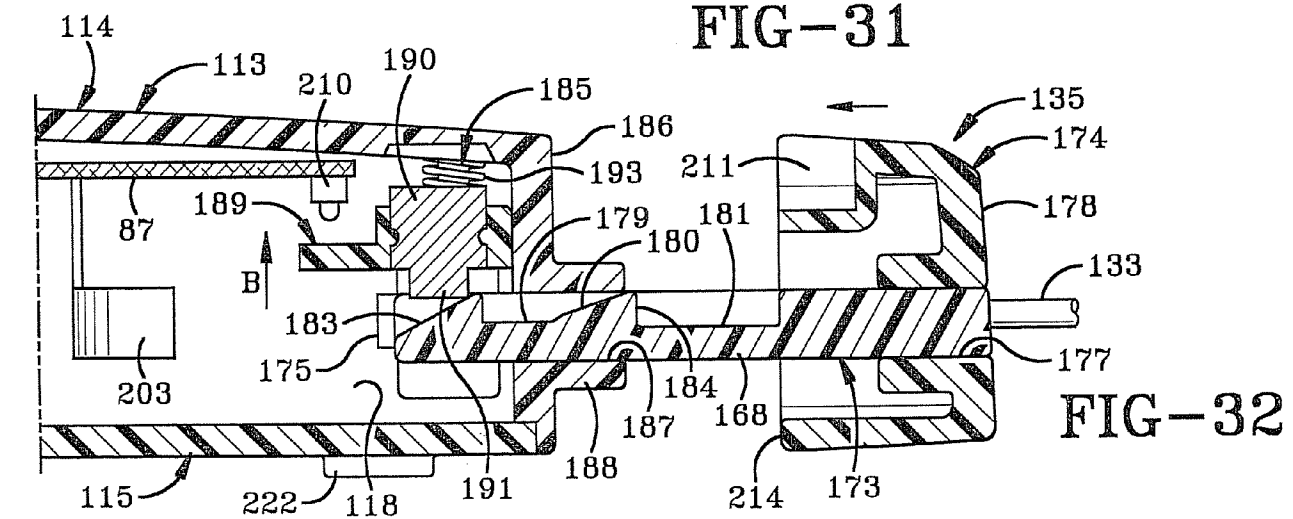
FIG. 32 is a fragmentary sectional view showing the clip being moved from the position of FIG. 31 into engagement within the end of the housing of the security device.

A ratchet mechanism which engages spool teeth 149 to prevent movement of the spool in the unwinding direction includes' a spring biased spool locking lever 162 (FIGS. 22B and 28) which is biased by U-shaped spring 163 into engagement with the spool gear teeth formed on spool flanges 145 and 146. Locking lever 162 is pivotally mounted within spool compartment 116 as shown in FIG. 39 by a pivot pin 165 and biased toward engagement with the spool teeth. As shown in FIG. 28, a pair of spaced projections 166 are formed on one end of locking lever 162 which engage the pair of spaced gear teeth on flanges 145 and 146 as shown in FIG. 30. The use of the pair of gear teeth and a pair of projections 166 provide increased resistance to tampering by a thief and increased security projections to security device 110 since it is able to withstand greater tension on the attached cables.

In accordance with one of the features of the invention, a release button 169 (FIGS. 22B and 30) is pivotally mounted in spool compartment 116 by pivot pin 165. Release button 169 includes an outwardly projecting pawl 171 on the opposite end from the pivot, the function of which is discussed further below. In accordance with another feature of the invention, attachment clip 135 (FIG. 22A) includes a locking clip indicated generally at 173 and a clip housing 174. Cable 133 is shown as being two cable sections which are secured in locking clip 173 by a pair of metallic ferrules 175. Ferrules 175 are attached to the ends of cables 133 and seated in compartments 167 formed in clip 173 to secure the cables in one end of locking clip 173. Cables 133 extend outwardly through an elongated slot 177 (FIG. 27) formed in end wall 178 of clip housing 174. Locking clip 173 has a generally planar rectangular configuration and is divided by a slot 170 into a pair of legs 168. Each leg is formed with a first pair of spaced recesses 179 (FIGS. 22A and 31), each of which terminates in an upwardly extending tapered rear wall 180 opposite a right angled shoulder 184, and has a second pair of recesses 181 spaced rearwardly from recess 179. The front edges of locking clip legs 168 have tapered surfaces 183 adjacent the first pair of recess 179. The function of these recesses and angled surfaces are discussed further below with respect to the placement and locking of attachment clip 135 within lock compartment 118.

Figures 22, 22A:
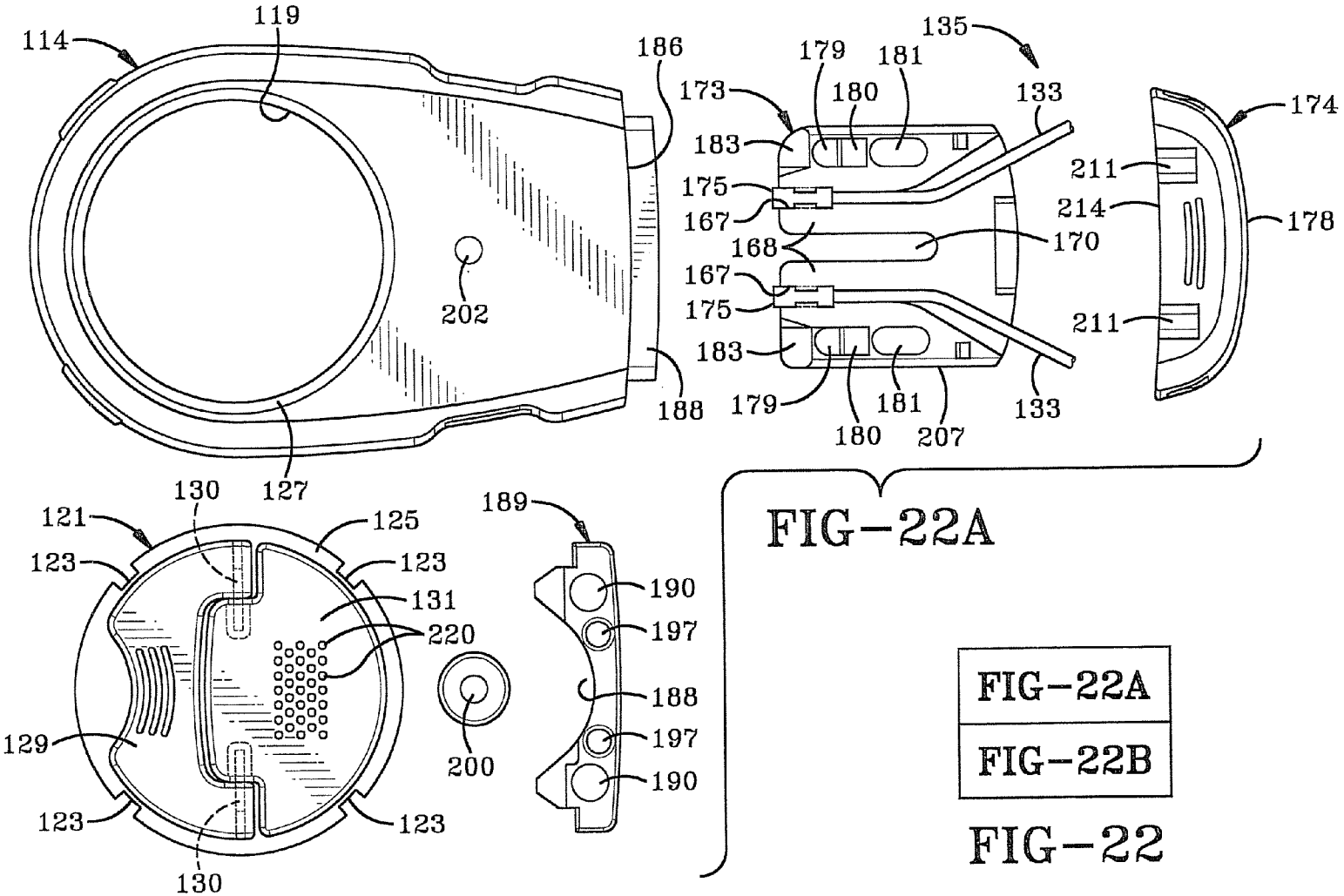
FIG. 22 is a combination of FIGS. 22A and 22B which are plan views of the major components of the security device of FIG. 21.
Figure 35:
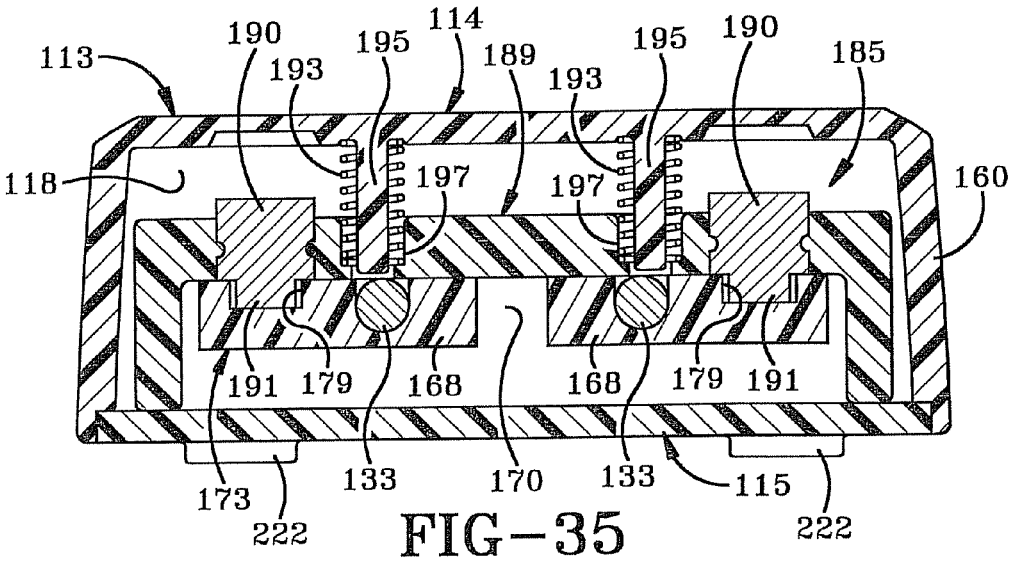
FIG. 35 is a sectional view taken on line 35-35, FIG. 33.

A locking mechanism indicated generally at 185, is mounted at the attachment clip entrance end 186 of housing 113. Entrance end 186 is formed with a slotted opening 187 formed by an outwardly extending rectangular frame 188 (FIG. 31) for slidably receiving locking clip 173 therein as discussed further below. Locking mechanism 185 includes a locking shuttle 189 having a pair of spaced locking plungers 190 preferably formed of a magnetically attractable material such as metal, having end locking projections 191 which are engageable in recesses 179 and 181 of locking clip 173 to dock attachment clip 135 to housing 113. Shuttle 189 has a concave recess 188 which provides clearance from a battery 199 when in the locked position. A pair of coil springs 193 are mounted about a pair of posts 195 which are formed integrally on the inside surface of top housing member 114 (FIGS. 23 and 35) and which extend into aligned holes 197 formed in locking shuttle 189 (FIGS. 22A and 35). Springs 193 bias locking shuttle 189, and in particular, locking plunger ends 191 into locking engagement with recesses 179 and 181 of locking clip 173.

Modified security device 110 includes piezo alarm 85 which is located within lock compartment 118, and is operatively engaged with printed circuit board 87 powered by battery 199 (FIG. 38). A light pipe 200 (FIG. 38) may be mounted in a hole 202 formed in top housing member 114, adjacent an LED 201 mounted on circuit board 87, which is lighted when the alarm circuitry formed on printed circuit board 87 is activated upon attachment clip 135, and in particular, locking clip 173 being in its final locking position as shown in FIGS. 21, 35, 36, 37 and 38. In this final locked position, ferrules 175 which are mounted on the ends of cables 133, engage electrical contacts 203 which extend downwardly from printed circuit board 87 and are electrically connected thereto to complete the alarm circuit of printed circuit board 87 through cables 133 by the electrical connection between contacts 203 and ferrules 175. This provides for the sense loops extending through cables 133.

An EAS tag could be mounted within lock compartment 118 or at other locations within device 110 if desired to add additional security to the device.

A cable crossover pad 205 (FIG. 21) may be mounted on cables 133 and is generally located on an opposite side of a package from that of security device 110. Pad 205 assists in maintaining the cables about the protected package or other item making it more difficult to slip the cable off of the edges of the package. Pad 205 can also contain some of the alarm circuitry contained in housing 113 indicated at 206. By placing some of the electronics of the alarm circuitry in crossover pad 205 it can reduce the size and complexity of security device 110. The EAS tag could also be placed easily in or on crossover pad 205 if desired.

Figure 22B:
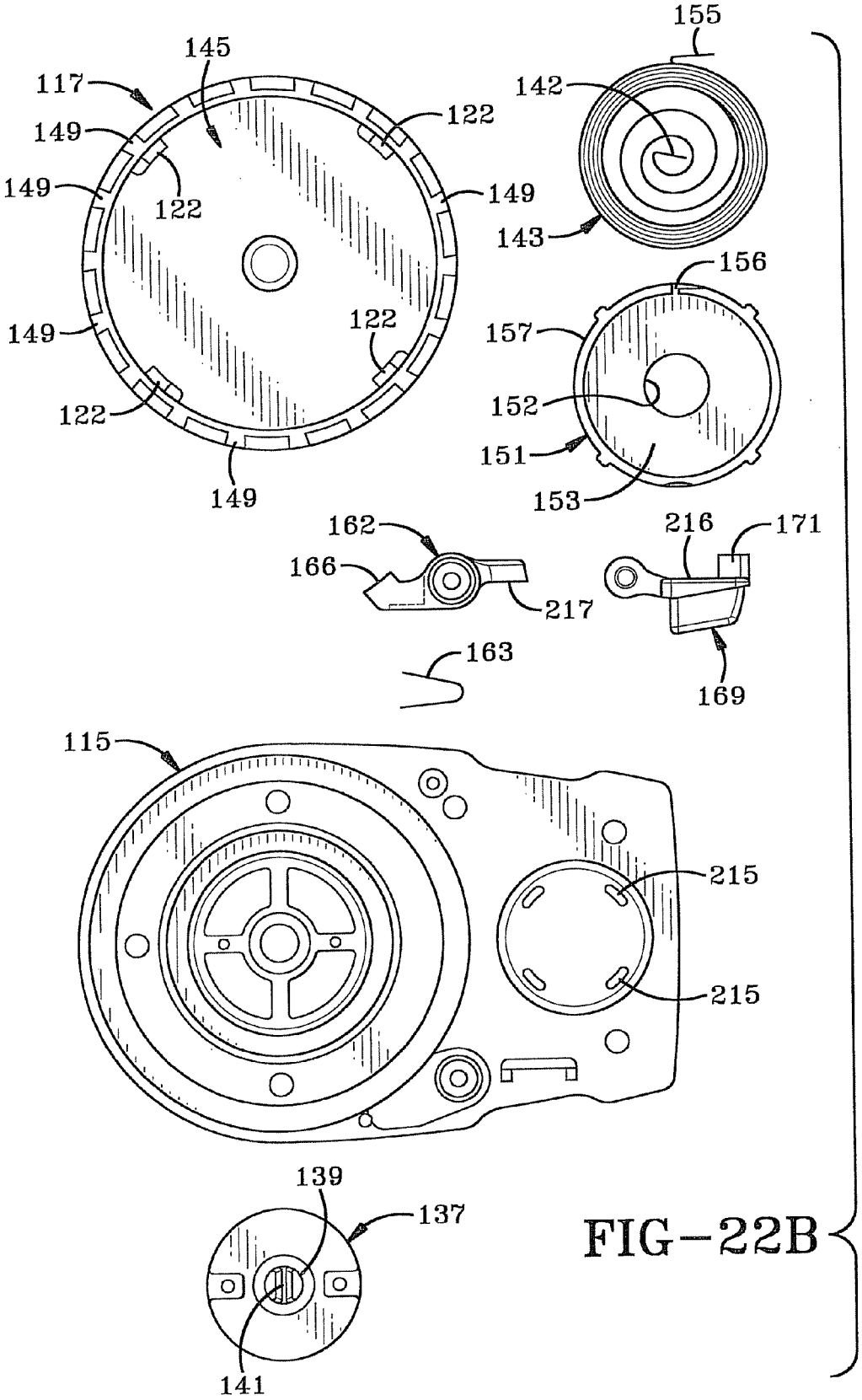
Figure 23:
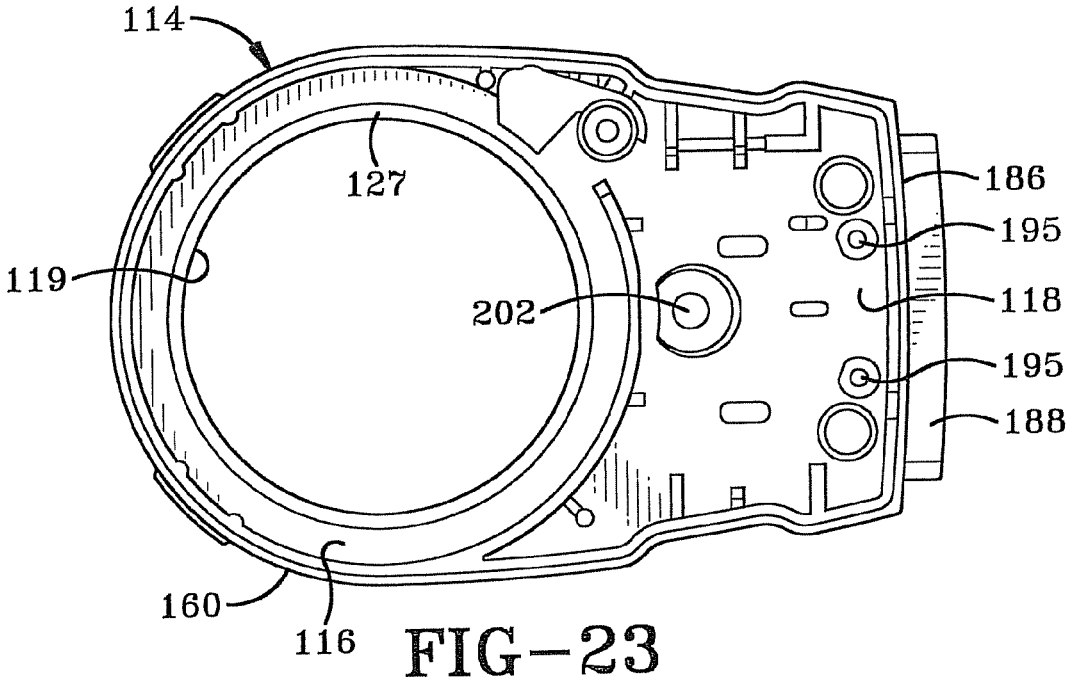
FIG. 23 is a plan view of the inside of the top housing component.
Figure 24:
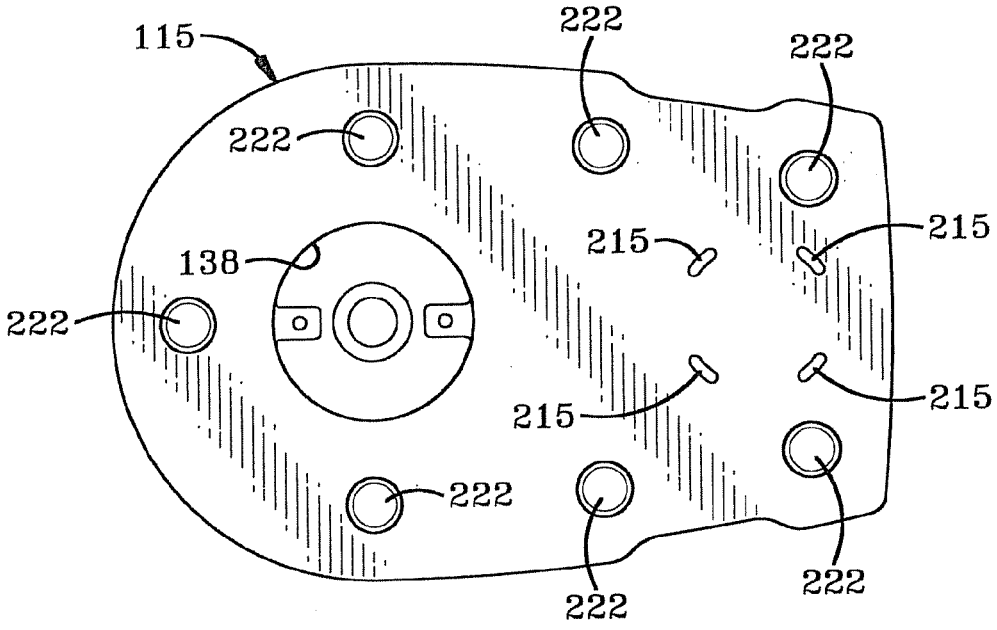
FIG. 24 is a plan view of the outside of the bottom housing component.
Figure 25:
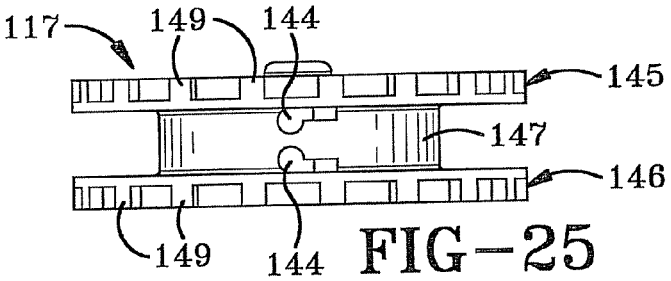
FIG. 25 is a side elevational view of the spool of the modified security device of FIG. 21.
Figure 27:
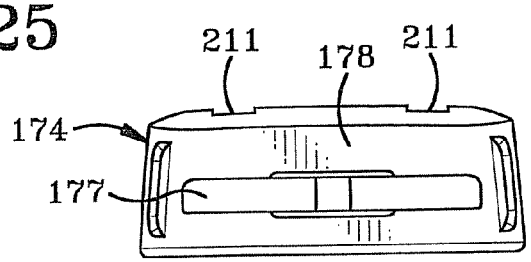
FIG. 27 is an end view of the clip housing of the modified security device.
Figure 26:
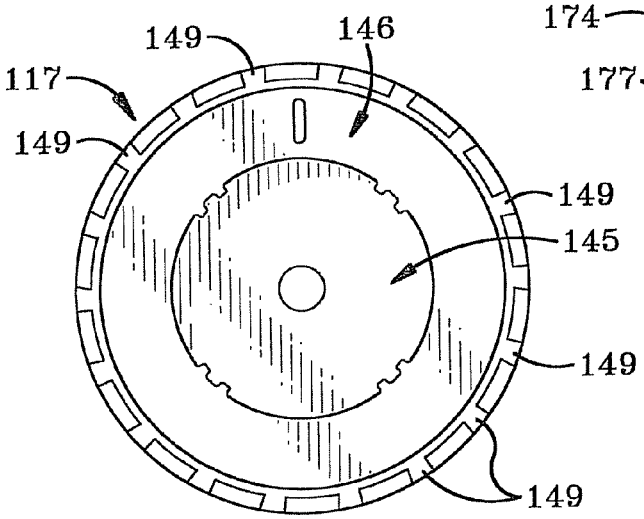
FIG. 26 is a bottom plan view of the spool of FIG. 25.
Figure 33:
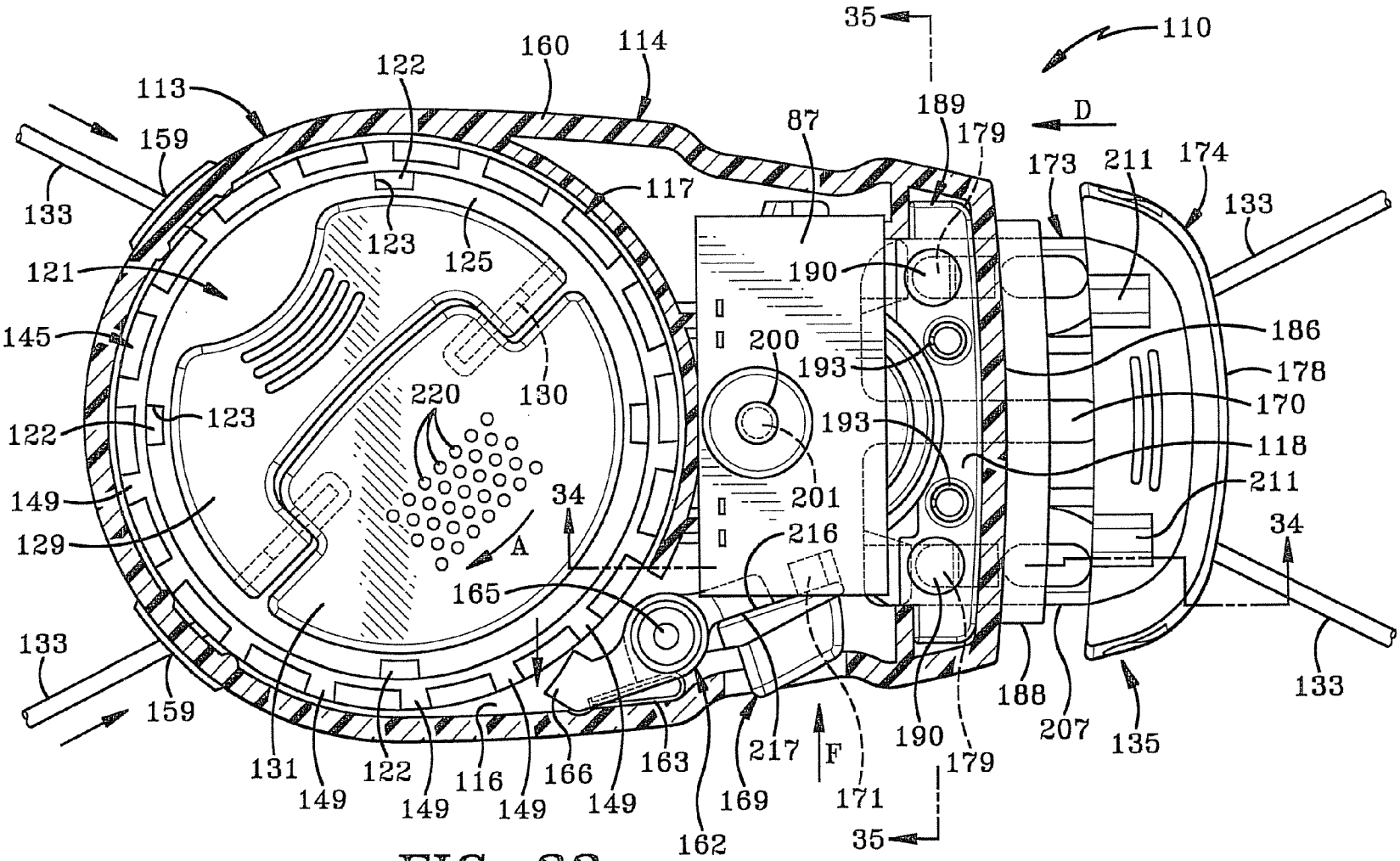
FIG. 33 is a fragmentary top plan view with portions in section similar to FIG. 30 showing the clip moving into a first locked position with the housing.
Figure 34:
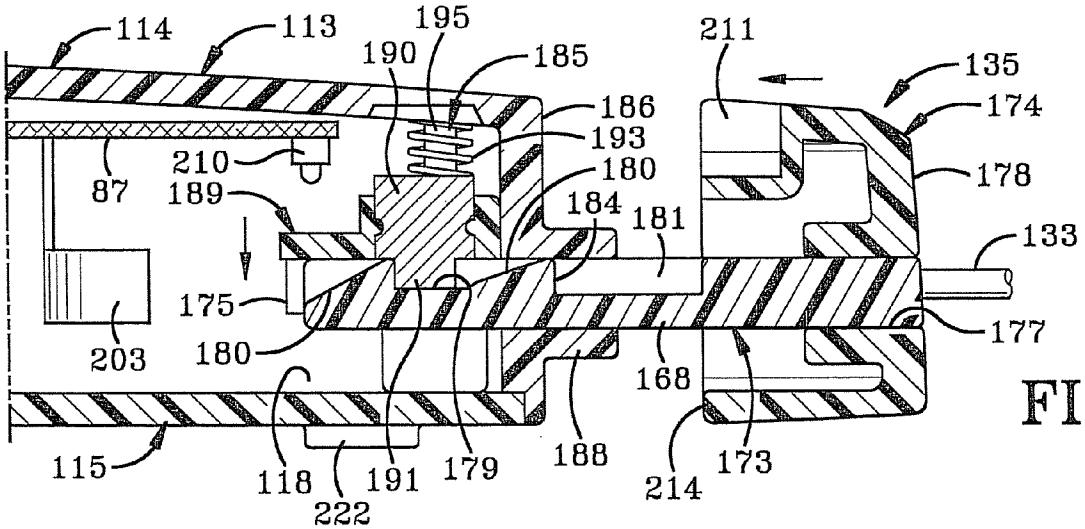
FIG. 34 is a fragmentary sectional view taken on line 34-34, FIG. 33.

The manner of operation of the modified security device 110 is best shown in FIGS. 30-40. When in the unlocked position as shown in FIG. 30, a clerk will depress button 169 such as shown in FIG. 33 which will pivot locking lever 163 in a counterclockwise direction since surface 216 of button 169 is abuttingly engaged with surface 217 of lock lever 162 (FIG. 22B). This pivotal movement of locking lever 162 will disengage projections 166 from gear teeth 149 placing spool 117 in a free wheeling condition in the unwind direction. A clerk will pull outwardly on attachment clip 135 which will overcome any bias of spring 143 on spool 117 and unwind a sufficient amount of cable 133 from about spool 17 enabling the cable to be placed about the corners of the package until clip 135 reaches the position as shown in FIG. 30 where attachment clip 135 is at entrance slot opening 187. This unwinding of cable 133 from spool 117 will further tension spool spring 143 tending to wind cable 133 on the spool. However, this is prevented upon the clerk releasing pressure on button 169 since U-spring 163 will bias locking lever 162 and projections 166 thereof back into locking engagement with gear teeth 149. The clerk will then insert clip 135 into slot opening 187 from the unlatched and unlocked position of FIGS. 30, 31 to the partially locked position of FIGS. 32 and 33. Upon locking clip 173 being inserted through slot opening 187 (FIG. 32), the tapered or ramped ends 183 of locking clip 173 will move locking plungers 190 from their downwardly biased position of FIG. 31 to a raised position of FIG. 32 as shown by Arrow B. As locking clip 173 is inserted further into opening 187 of housing 113 from the position of FIG. 32 to that of the first locked position of FIGS. 33 and 34, locking plungers 190 are biased downwardly by springs 193 into the first pair of recesses 179. When in this first locked position of FIG. 37, locking clip 173 is prevented from being removed from housing 113.

Even though spool 117 is biased in the windup direction by spring 143, it is prevented from retracting the cable by locking lever projections 166 engaging spool teeth 149. The clerk then positions the cable about the package and then depresses button 169, as shown by Arrow F in FIG. 33. Spring 143 will rotate spool 117 in the windup direction which will automatically tension the cable about the package by the slack in the cable being taken up automatically by the biased rotation of spool 117. The clerk then moves attachment clip 135 from the first locked position of FIG. 33 in the direction of Arrow D into the fully locked position of FIG. 36. During this movement, locking clip 173 moves from the first locked position of FIG. 34 to the full locked position of FIG. 37 wherein locking projections 190 are initially raised upwardly as they move along upwardly tapered surfaces 180, after which they automatically drop into locking recesses 181 where they are prevented from backward movement by vertical wall or shoulder 184. Upon reaching this full locked position, ferrules 175 engage electric contacts 203 of printed circuit board 87 providing an electrical path through the conductors of cable 133 and the alarm circuit providing sense loops through the cables so that piezo alarm 85 will sound should cable 133 be severed by a potential thief. Before moving into this fully locked position of FIGS. 36 and 37, depression of button 169 was removed whereupon U-spring 163 biased locking lever 162 inwardly so that locking projections 166 enter into the adjacent gear teeth 149 as shown in FIG. 30. When in this locked position, pawl 171 of button 169 is located adjacent side edge 207 of locking clip 173 (FIG. 36), which prevents depression of button 169 inwardly, preventing the removal of locking projections 166 from within gear teeth 49. Thus, upon locking clip 173 reaching the full locked position of FIGS. 35, 36 and 37, the cable is tensioned about the package by the force exerted on cable 133 by coil spring 143. However, the clerk merely raises up flip-up handle 129 of winder mechanism 121 and manually rotates the winder mechanism attached to spool 117 in a clockwise direction as shown by Arrow A, FIG. 39 to further tighten the cable about the package to a desired tension. The cable will move in the tightening or windup direction since locking lever 162 can pivot in a counterclockwise direction as shown in FIG. 39, but not in a clockwise direction when engaged with spool teeth 149 due to the abutment of locking lever surface 217 with button surface 216. Button 169 is prevented from inward movement by the engagement of pawl 171 with side edge 207 of locking clip 173. The contact between ferrules 175 and printed circuit board contacts 203 will activate the alarm circuitry and light LED 201 which is visible to a clerk and potential thief through light pipe 200.

Figure 40:
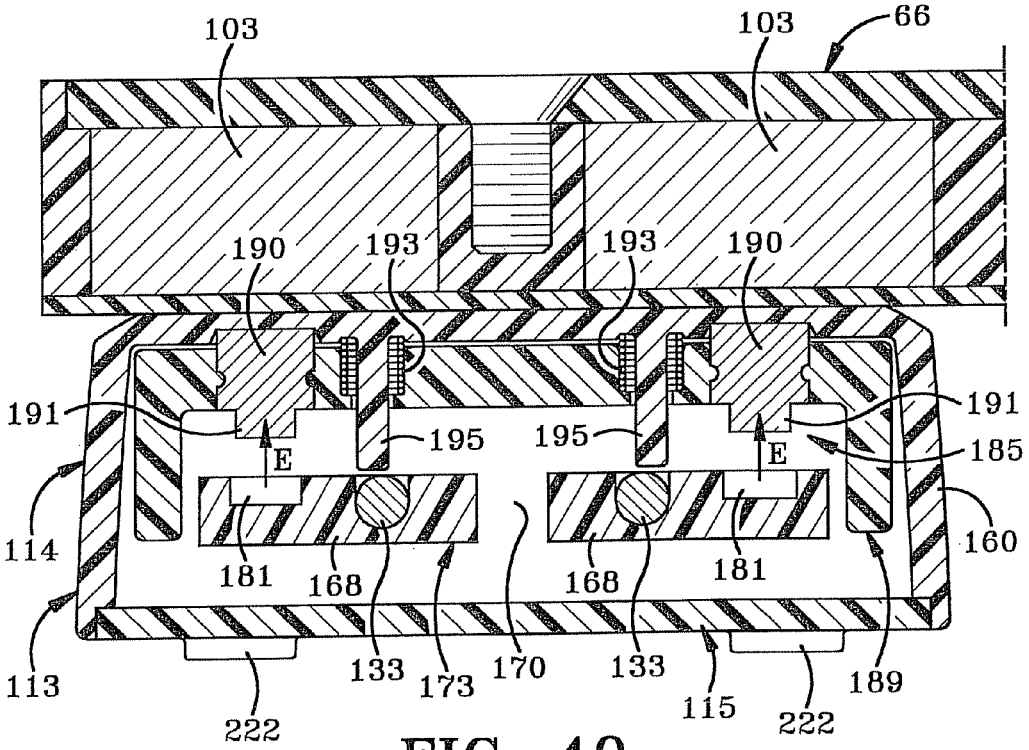
FIG. 40 is a sectional view similar to FIG. 35 showing the magnetic key unlocking the clip from the housing.
Figure 36:
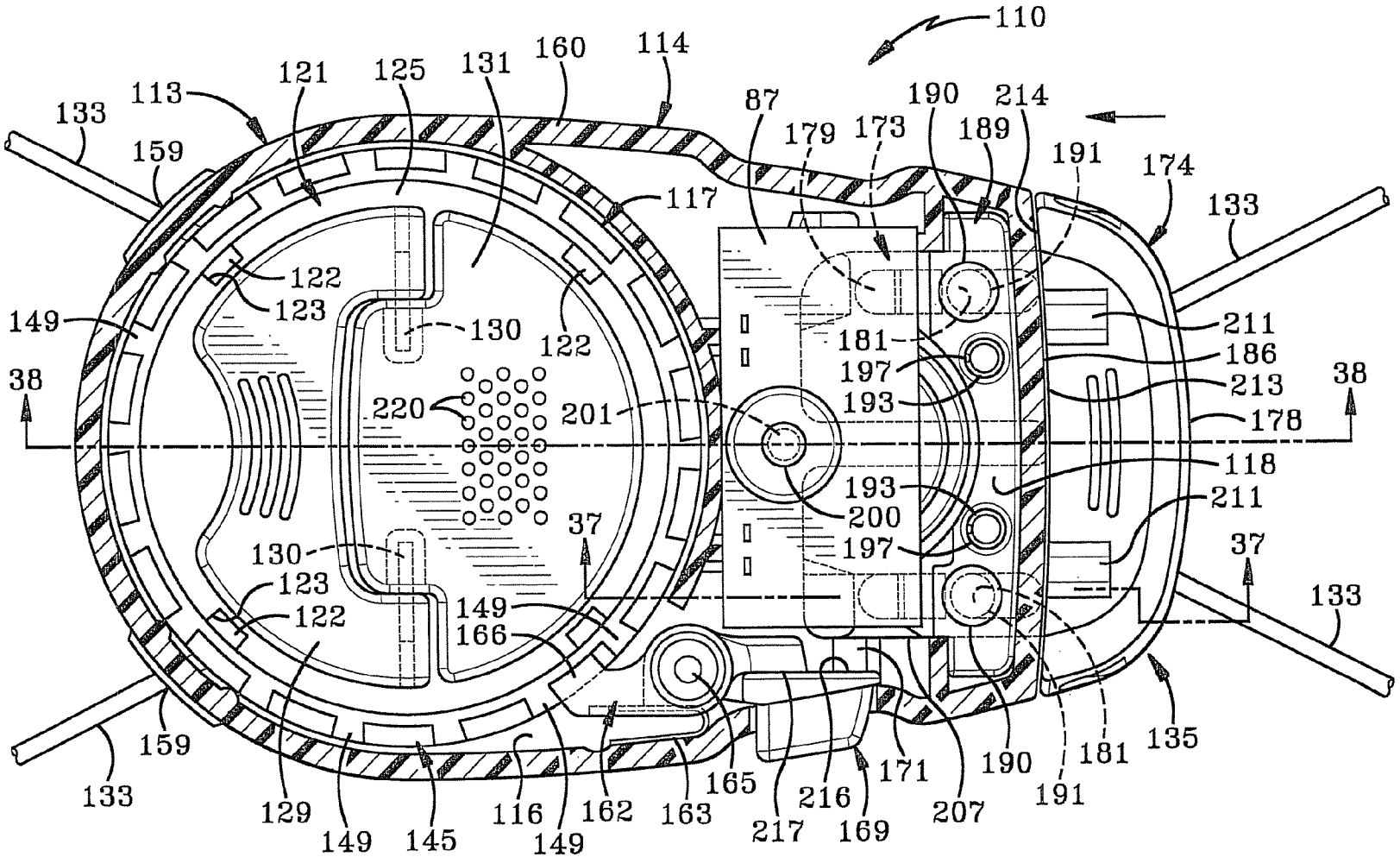
FIG. 36 is a fragmentary top plan view with portions in section similar to FIG. 33 showing the clip in a fully locked position within the housing of the security device.

To unlock the locked mechanism, magnetic key 66 (FIG. 19) is properly placed on the top surface of clip housing 174 by inserting locating projections 65 into alignment holes 211 formed in clip housing 174. This alignment ensures that magnets 103 are properly aligned with locking plungers 190 as shown in FIG. 40. Magnets 103 will move locking plungers 190 from their locked position of FIG. 35 to the unlocked position of FIG. 40 as shown by Arrows E. Upon reaching the unlocked position of FIG. 40, clip 173 is easily removed from housing 113 by sliding the locking clip out through slot opening 187.

In accordance with another feature of the invention, upon the upward movement of plungers 190 and shuttle 189 by the attraction toward magnets 103, shuttle 189 will engage and depress a switch 210 mounted on printed circuit board 87 (FIGS. 32 and 37) which will deactivate the alarm circuitry preventing the sounding of the alarm upon removal of clip 135 from housing 113.

After attachment clip 135 has been removed from the housing 113 back to the position of FIG. 30, pawl 171 is disengaged from side edge 207 of locking clip 173 whereupon button 169 can be depressed which will disengage locking projections 166 from within spool teeth 149 which will automatically retract the cables back into the housing and about spool 117 due to the biasing force exerted thereon by spring 143. Thus, a clerk merely removes attachment clip 135 from within housing 113 after placing key 66 therein and by depression of release button 169 will control the windup of the cable back into the housing about the spool until clip 135 reaches a position closely adjacent the opposite end of housing 113 from that of the entrance end 186, or until crossover pad 205 engages the end of housing 113 if a pad 205 is used with security device 110. This automatic retraction of the cable back into the housing prevents excess cable from remaining dangling from housing 113, which heretofore became tangled with adjacent products or other security devices and cables.

As with security device 1 described above, the alarm system provides the desired security preventing cable 133 from being severed without sounding the internal alarm and enables the cable to be tightened about the product to the desired tension by easily manually rotating flip-up handle 129. It is readily understood that crossover pad 205 may or may not be used with modified security device 110 and it may or may not include portions of the alarm circuitry or contain an EAS tag therein as discussed above.

Figure 37:
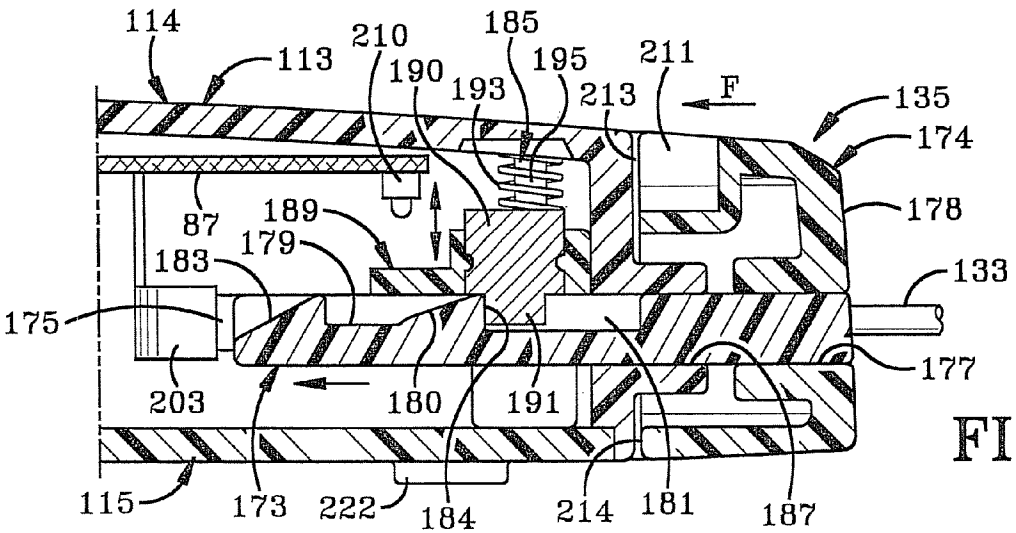
FIG. 37 is a fragmentary sectional view taken on line 37-37, FIG. 36.

When in the fully locked position as shown in FIGS. 37 and 39, a slight gap 213 may be formed between the inner edge 214 of clip housing 174 which enables attachment clip 135 to be manually moved slightly inwardly in the direction of Arrow F as shown in FIG. 37, when a clerk starts to unlock security device 110 and remove attachment clip 135 from the housing. This slight inward movement facilitates the upward movement of locking plungers 190 by eliminating the friction force created between the edge of locking plunger end 191 with recess shoulder 184, which heretofore was tightly clamped together by the tension of the coil spring attempting to pull attachment clip 135 out of engagement from within housing 113. Thus, a clerk upon placing magnet key 66 in the position as shown in FIG. 40, pushes slightly inwardly on attachment clip 135 to reduce the pressure between the locking plungers and the locking clip until the locking plungers have been retracted facilitating the unlocking, and removal of the attachment clip from within the housing. Furthermore, the use of only two cables around spool 117 or one continuous cable loop enables a tighter winding of the cables on the spool and less force on the locking lever and results in considerably less tangling of cables as occurs when four separate cables are used as in prior cable wrap security devices.

Figure 21:
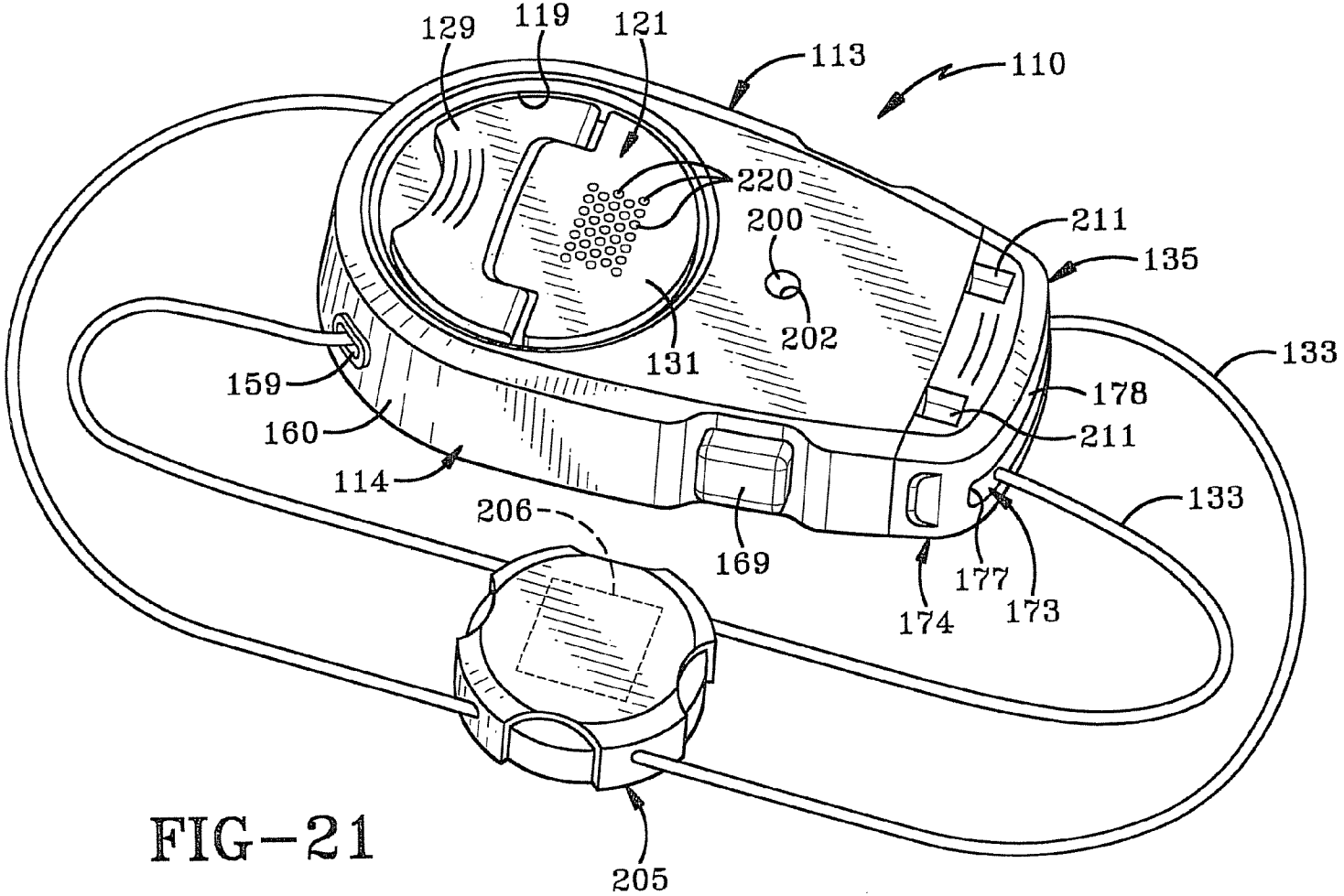
FIG. 21 is a diagrammatic top perspective view of a second embodiment of the security device of the present invention.

Furthermore, the elongated, somewhat oblong shape of housing 113 as shown in FIG. 21, provides a device which is more easily gripped by a clerk than when the security device is circular, since it remains in a constant gripped position within the hand of the clerk to further facilitate the winding and unwinding of the cable from the spool upon depression of button 169.

Another advantage of security device 110 is that piezo alarm 85 is located closely adjacent bottom housing member 115 as shown in FIG. 38 and a plurality of speaker holes 215 (FIG. 22B) to provide protection from a potential thief who could attempt to gain access to the speaker and electronics through the speaker holes if the holes were exposed on top of the security device. This results in the speaker holes and alarm to be face down when security device 110 is secured on an object which prevents a thief from disabling the alarm by inserting a sharp object through the speaker holes which can occur if the speaker holes are exposed. Simulated speaker holes 220 may be formed in disc 131 indicating to a thief that an alarm may be contained in the housing. Furthermore, small standoff feet or projections 222 preferably extend from the bottom surface of bottom housing member 115 providing better sound transmissions from alarm 85 when actuated by providing a gap or spacing between the speaker holes and secured object.

It is also possible in accordance with the present invention, to form attachment clip 135 as two separate clips, each of which is attached to one of a pair of cables and individually inserted through end openings in the housing and locked by a locking mechanism similar to that described above. This enables at least one of the cables to be inserted through a small opening of a product being protected thereby which would provide protection to that product without requiring the product being a box or a similar parallelepiped configuration. Likewise, it is understood that attachment clip 135 can be inserted through openings in a product before being latched to housing 113 providing a security device having an alarm which could secure the product to a support structure or the like.

Another advantage of security device 110 is that upon a large force being exerted on cable 133, the cable can be pulled away from ferrules 175 (FIG. 30) or the ferrules will break electrical contact with contacts 203 (FIG. 37) causing alarm 85 to be actuated.

Again, the attachment of only two cable loops or cable sections to the attachment clip which is detached from the housing when in the unlocked position, enables the cables to be retracted into the housing until needed, eliminating exposed cables susceptible to tangling as occurs in prior art cable wrap security devices. Likewise, the retraction spring mechanism enables cable slack to be easily taken up after placing the cable about an object prior to manually tightening the cable, and after the cable has been removed from a protected object.

The term "lock" or "locked" as used in this description means that a key of some type is required to change the state from locked to unlocked to distinguish from the term "latched" to describe a connection between two elements where a key is not required to undo the elements.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claim is:

1. A security device for placement about a package, the security device comprising:

a cable;

a housing;

a spool carried by the housing for receiving the cable;

a ratchet assembly engagable with the spool;

a clip connected to the cable, wherein the clip is configured to engage with the housing in a first locked position and a second locked position; and a lock device configured to lock the clip to the housing when the clip engages the housing in the first locked position and the second locked position;

wherein the ratchet assembly is configured to tighten the cable about the package when the clip is in the first locked position;

wherein movement of the clip from the first locked position to the second locked position causes the cable to further tighten about the package; and wherein the spool is free wheeling in a cable loosening direction when the clip is not engaged with the housing and the spool is prevented from free wheeling in a cable loosening direction when the clip is engaged with the housing in the second locked position.

2. The security device of claim 1 wherein the clip further includes a first recessed area and a second recessed area;

wherein the lock device includes a locking projection; and wherein the locking projection is in the first recessed area when the clip is in the first locked position, and the locking projection is in the second recessed area when the clip is in the second locked position.

3. The security device of claim 2 wherein the lock device further comprises a locking pin, and the clip further comprises a first beveled portion and second beveled portion; wherein the first beveled portion is shaped to guide the locking pin into the first recessed area and the second beveled portion is shaped to guide the locking pin from the first recessed area to the second recessed area.

4. The security device of claim 1 wherein the cable further comprises:

a first cable section passing through a crossover device with a first end connected to the clip and a second end connected to the spool; and a second cable section passing through the crossover device with a first end connected to the clip and a second end connected to the spool.

5. The security device of claim 1 further including:

a spring configured to bias the spool in a cable takeup direction.

6. The security device of claim 1 wherein the clip is formed with first and second longitudinally aligned locking recesses; and in which the lock device progressively engages the locking recesses to engage the clip with the housing.

7. The security device of claim 1 wherein the ratchet assembly further includes:

a pivotally mounted flip-up handle for rotating the spool in a cable takeup direction to tighten the cable about the package.

8. The security device of claim 1 wherein the lock device further includes:

at least one magnetically attractable locking member moveable between a locked position that engages the clip and an unlocked position where the locking member does not engage the clip, and wherein the locking member is biased toward the locked position.

9. The security device of claim 1 wherein the cable further comprises:

a pair of cable loops with each loop terminating in an electrical connector, wherein the electrical connectors engage electrical contacts of an alarm logic when the clip is engaged with the housing.

10. The security device of claim 1 further comprising:

a crossover device, wherein the cable passes through the crossover device at least twice, and wherein the crossover device is configured to be placed on a side of the package opposite from the side of the package that the housing is placed on.

11. A security device for placement about a package, the security device comprising:

a cable;

a housing;

a spool carried by the housing for receiving the cable;

a ratchet assembly engagable with the spool;

a clip connected to the cable, wherein the clip is configured to engage with the housing in a first locked position and a second locked position; and a lock device configured to lock the clip to the housing when the clip engages the housing in the first locked position and the second locked position;

wherein the ratchet assembly is configured to tighten the cable about the package when the clip is in the first locked position;

wherein movement of the clip from the first locked position to the second locked position causes the cable to further tighten about the package; and wherein in the second locked position an electrical connection is made, and in the first locked position the electrical connection is not made.

* * * * *